US008863828B1

(12) United States Patent
Strong

(10) Patent No.: US 8,863,828 B1
(45) Date of Patent: Oct. 21, 2014

(54) STRIPPER DEVICE WITH RETRIEVAL MOUNTING PORTION AND METHOD OF USE

(71) Applicant: George Thomas Strong, Longview, TX (US)

(72) Inventor: George Thomas Strong, Longview, TX (US)

( * ) Notice: Subject to any disclaimer, the term of this patent is extended or adjusted under 35 U.S.C. 154(b) by 0 days.

(21) Appl. No.: 13/657,619

(22) Filed: Oct. 22, 2012

Related U.S. Application Data

(60) Continuation of application No. 13/107,914, filed on May 15, 2011, now abandoned, which is a division of application No. 12/916,560, filed on Oct. 31, 2010, now abandoned.

(60) Provisional application No. 61/280,450, filed on Nov. 4, 2009.

(51) Int. Cl.
*E21B 27/00* (2006.01)

(52) U.S. Cl.
USPC ..... 166/69; 166/107

(58) Field of Classification Search
USPC ..... 166/107–111, 68, 69
See application file for complete search history.

(56) References Cited

U.S. PATENT DOCUMENTS

| | | | | |
|---|---|---|---|---|
| 65,121 | A | 5/1867 | Roberts | |
| 952,393 | A * | 3/1910 | Whitehill | 294/68.25 |
| 1,130,181 | A | 3/1915 | Lock | |
| 1,145,158 | A | 7/1915 | Mapes | |
| 1,158,292 | A | 10/1915 | Rigby | |
| 1,360,053 | A | 11/1920 | Stumpf | |
| 1,379,815 | A | 5/1921 | Hall | |
| 1,385,760 | A | 7/1921 | Swartz | |
| 1,523,604 | A | 1/1925 | Miller | |
| 1,537,201 | A | 5/1925 | Swan | |
| 1,559,635 | A | 11/1925 | Love et al. | |
| 1,561,327 | A | 11/1925 | Hedrick | |
| 1,574,809 | A * | 3/1926 | Gilbreath | 294/68.22 |
| 1,664,643 | A | 4/1928 | Rasmussen | |
| 1,776,889 | A | 9/1930 | Claytor | |
| 1,944,434 | A | 1/1934 | Keeler | |
| 2,125,762 | A | 8/1938 | Wheeler | |
| 2,155,601 | A | 4/1939 | Johnson | |
| 2,163,058 | A | 6/1939 | Phipps | |

(Continued)

FOREIGN PATENT DOCUMENTS

WO WO-2007084927 A2 7/2007

OTHER PUBLICATIONS

Schlumberger Oilfield Glossary entry for "lubricator," accessed Mar. 19, 2012 via www.glossary.oilfield.slb.com.

*Primary Examiner* — Blake Michener
(74) *Attorney, Agent, or Firm* — Gardere Wynne Sewell LLP

(57) ABSTRACT

A stripper device for a wellhead defining the terminus of an aliphatic hydrocarbon production well. The stripper device includes a lubricator assembly having a lubricator pipe in communication with the wellhead and a dipper assembly traversing within the lubricator pipe and the well. A controller assembly provides instructions in a computer readable format to regulate the collection of liquid aliphatic hydrocarbons from the well with the dipper assembly. The stripper device includes a recovery assembly having a pivot element coupled to a lubricator pipe and to the wellhead. The pivot element renders the lubricator pipe to communicate with the wellhead in a first position and renders the lubricator pipe apart from the wellhead in a second position to expose the wellhead free of obstructions including those from the lubricator assembly.

20 Claims, 17 Drawing Sheets

(56) References Cited

U.S. PATENT DOCUMENTS

| | | | | | |
|---|---|---|---|---|---|
| 2,214,196 | A | | 9/1940 | Hall | |
| 2,325,503 | A | | 7/1943 | Goble | |
| 2,449,721 | A | * | 9/1948 | Santiago | 248/146 |
| 2,755,863 | A | | 7/1956 | Stansbury et al. | |
| 2,785,756 | A | | 3/1957 | Reynolds | |
| 3,199,597 | A | | 8/1965 | Kelly | |
| 3,212,581 | A | | 10/1965 | Marshall | |
| 3,568,767 | A | | 3/1971 | Weiss | |
| 3,762,725 | A | | 10/1973 | Taylor | |
| 4,037,662 | A | * | 7/1977 | Bowling | 166/311 |
| 4,086,035 | A | | 4/1978 | Klaeger, Jr. et al. | |
| 4,192,377 | A | * | 3/1980 | Defourneaux, Jr. | 166/70 |
| 4,368,909 | A | | 1/1983 | Alexander, Jr. | |
| 4,423,774 | A | | 1/1984 | Mefford | |
| 4,516,911 | A | | 5/1985 | Senghaas et al. | |
| 4,583,916 | A | | 4/1986 | Senghaas et al. | |
| 4,751,969 | A | | 6/1988 | Klaeger | |
| 5,097,901 | A | * | 3/1992 | Klaeger | 166/68 |
| 5,131,466 | A | | 7/1992 | Chacin U. et al. | |
| 5,240,229 | A | * | 8/1993 | Timmons | 254/338 |
| 5,871,343 | A | | 2/1999 | Baukal, Jr. et al. | |
| 5,959,547 | A | | 9/1999 | Tubel et al. | |
| 6,230,802 | B1 | * | 5/2001 | Duhon | 166/278 |
| 6,356,205 | B1 | | 3/2002 | Salvo et al. | |
| 6,437,692 | B1 | | 8/2002 | Petite et al. | |
| 6,457,760 | B1 | | 10/2002 | Pratt | |
| 6,460,622 | B1 | | 10/2002 | Rice | |
| 6,464,012 | B1 | | 10/2002 | Strickland | |
| 6,615,924 | B2 | | 9/2003 | Rice | |
| 6,615,925 | B2 | | 9/2003 | Rice | |
| 6,637,515 | B2 | | 10/2003 | Bishop et al. | |
| 6,967,589 | B1 | | 11/2005 | Peters | |
| 6,985,750 | B1 | | 1/2006 | Vicknair et al. | |
| 7,044,215 | B2 | | 5/2006 | Boyles | |
| 7,308,933 | B1 | | 12/2007 | Mayfield et al. | |
| 7,347,256 | B1 | | 3/2008 | Eggleston | |
| 7,438,125 | B2 | * | 10/2008 | Victor | 166/68 |
| 7,481,271 | B2 | | 1/2009 | Grant | |
| 7,549,473 | B2 | | 6/2009 | Underwood | |
| 8,127,855 | B2 | | 3/2012 | Alvarado Vargas | |
| 2002/0104660 | A1 | | 8/2002 | Nice et al. | |
| 2002/0166662 | A1 | | 11/2002 | Eggleston | |
| 2003/0047316 | A1 | * | 3/2003 | Bosley | 166/372 |
| 2003/0058125 | A1 | | 3/2003 | Ciglenec et al. | |
| 2003/0192692 | A1 | | 10/2003 | Tubel | |
| 2004/0149436 | A1 | | 8/2004 | Sheldon | |
| 2005/0098322 | A1 | | 5/2005 | Balen | |
| 2005/0183860 | A1 | | 8/2005 | Golby et al. | |
| 2005/0189142 | A1 | | 9/2005 | Garcia et al. | |
| 2006/0032533 | A1 | | 2/2006 | Sheldon | |
| 2006/0235573 | A1 | | 10/2006 | Guion | |
| 2006/0283587 | A1 | | 12/2006 | Wood et al. | |
| 2007/0175640 | A1 | | 8/2007 | Atencio et al. | |
| 2008/0236834 | A1 | | 10/2008 | Creighton | |
| 2009/0000791 | A1 | | 1/2009 | Ice | |
| 2009/0101359 | A1 | | 4/2009 | Kauffman et al. | |
| 2009/0153354 | A1 | | 6/2009 | Daussin et al. | |
| 2011/0220368 | A1 | | 9/2011 | Heijnen | |
| 2012/0138312 | A1 | * | 6/2012 | Strong | 166/377 |

* cited by examiner

FIG. 8
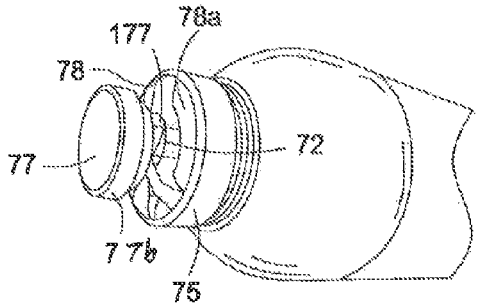
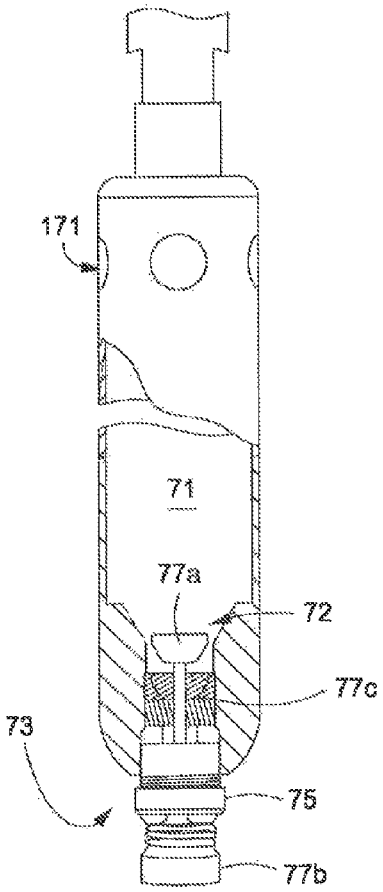
FIG. 9A
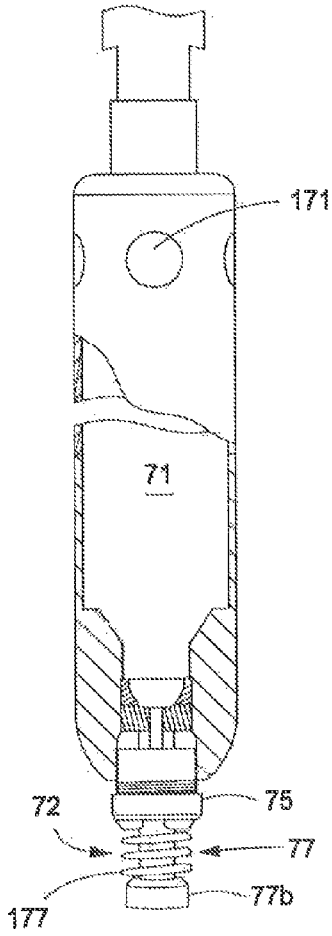
FIG. 9B

STRIPPER DEVICE WITH RETRIEVAL MOUNTING PORTION AND METHOD OF USE

CROSS REFERENCE TO RELATED APPLICATIONS

This application is a Continuation of Non-Provisional application Ser. No. 13/107,914, which is a Divisional of Non-Provisional application Ser. No. 12/916,560, filed Oct. 31, 2010, which claims benefit under 35 U.S.C. §119(e) from prior U.S. Provisional Patent Application Ser. No. 61/280,450 filed on Nov. 4, 2010 entitled "Stripper Device and Method of Use", by inventor George Thomas Strong, the entire contents of the above referenced Applications are hereby incorporated by reference as if fully set forth herein.

BACKGROUND OF THE INVENTION

1. Field of the Invention

The present invention generally relates to aliphatic hydrocarbon recovery systems for stripper wells. More particularly, but not by way of limitation, the present invention relates to a stripper device for extracting aliphatic hydrocarbons from a well in an operational position and featuring a pivot element for rendering a lubricator assembly apart from the wellhead in an access position whereby, for example, a dipper assembly having an interchangeable fishing neck assembly may be retrieved from downhole for servicing while in the access position.

2. Description of Related Art

Aliphatic hydrocarbons, which include petroleum and natural gases, are the most important energy source today and also serve as the raw materials for chemical products that markedly enhance the "standard of living" within developed populations. As a type of fossil fuel, aliphatic hydrocarbons are a limited natural resource whereby a growing demand for energy by rapidly emerging industrialized nations aggregated with the significant energy needs from established information-age societies has made the advent of global peak oil production eminent. Accordingly, several governmental initiatives throughout the world are presently directed toward clean energy and highly managed systems of localized hydrocarbon production in lieu of importation. Today, as fossil fuels continue to become more difficult to extract and market prices for petroleum and other hydrocarbons continue to dramatically increase, there exists a greater interest in off-shore production and reclamation of stripper wells.

In recent years, marginal or "stripper" wells are becoming more common in long established oil and gas producing regions as these natural resource reserves near the end of their economically useful life. Generally, as in one illustration, a stripper well may produce an average of less than twenty barrels of oil per day of which the majority of all petroleum wells within the continental United States are presently classified as stripper wells.

Commonly, in one illustration, a stripper well includes a pumpjack coupled to a wellhead to facilitate the extraction of fossil fuels from the well. However, many problems arise with utilizing a pumpjack on a marginally producing well in that pumpjacks are ideally designed for production activity within highly productive fields. For example, if not vigilantly attended to, a pumpjack may overwork a marginal well too fast to thus draw too much saltwater or even deplete the hydrocarbons therefrom without a natural recharge period. Unfortunately, operating pumpjacks with stripper wells also typically includes significant expenses of legal saltwater disposal and obtaining equipment for retrieving and servicing the sucker rods, pump, and mechanical truing of various well components in the frequent event of wear as well as the possible need to washout sand and other nearby debris from the casing.

Sustained operation of each stripper well is economically tenuous. Illustratively, a stripper well operators' profit varies dramatically depending on the market price of fossil fuels as well as operating costs. At times, to the detriment of polluting the nearby environment, well operators are faced with abandoning or "orphaning" a stripper well in that the stripper well is not profitable and the operator cannot afford well plugging service fees for properly retiring the well.

Unfortunately, there is no known device or method for providing sustained operation of a marginal aliphatic hydrocarbon well while providing ease of servicing. Therefore, a need exists for a system and method for extracting aliphatic hydrocarbons from a wellhead in an operational position and features a pivot element for rendering a lubricator pipe apart from the wellhead in an access position for easy entry to the wellhead for downhole servicing. There is also a need for a device and method for quickly and reliably retrieving hydrocarbon fluids from a stripper well that provides interchangeable components for ease of downhole servicing.

SUMMARY OF THE INVENTION

Aspects of the present invention are found in a stripper device for a wellhead defining the terminus of an aliphatic hydrocarbon well. The stripper device includes a lubricator assembly having a lubricator pipe in communication with the wellhead and a dipper assembly traversing within the lubricator pipe and the well. A controller assembly provides instructions in a computer readable format to regulate the collection of liquid aliphatic hydrocarbons from the well with the dipper assembly. The stripper device includes a recovery assembly having a pivot element coupled to the lubricator pipe and to the wellhead. The pivot element renders the lubricator pipe to communicate with the wellhead in a first position and renders the lubricator pipe apart from the wellhead in a second position to expose the wellhead free of obstructions including those from the lubricator assembly.

In one aspect, a stripper device includes a retrieval mounting portion coupled to the dipper assembly for fixedly receiving a variety of fishing neck assemblies of a type well known in the industry. In a further aspect, the stripper device includes an impact compensator at the exterior surface of the dipper body and coupled to a removable striker unit. The impact compensator maintains a seal established by the striker unit to contain liquid aliphatic hydrocarbons within the dipper assembly while submerged within a liquid column adjacent to the downhole fluid boundary.

In one aspect, a stripper device includes a fluid indicator coupled to the wireline and the controller assembly. The fluid indicator facilitates determination of the depth within the well at which the dipper assembly hits fluid. In one further aspect, the fluid indicator includes a quantity indicator that measures the amount of tension across the wireline to provide data to the controller assembly. Accordingly, the controller assembly determines the amount of desired fluid within the dipper assembly coupled to the wireline based on the net weight of the contents in the dipper assembly and the predetermined density of the desired fluid, such as petroleum.

In one aspect, the dipper assembly for a stripper device coupled to the wellhead of an aliphatic hydrocarbon production well includes a dipper body and a removable striker unit coupled to the dipper body. The striker unit including a collection valve for rendering between a fill position and a draw position to selectively seal liquid aliphatic hydrocarbons in the dipper body. In one further aspect, the dipper assembly includes a retrieval mounting portion disposed on one end of the dipper body. As such, a control module coupled to the wireline positions the dipper assembly within the well with the wireline coupled to the dipper body at the fishing neck assembly.

In one aspect, a control system for a stripper device at a well site includes a network of stripper devices. The network provides instructions in a computer readable format to each stripper device and is coupled to a SCADA controller. The SCADA controller distributes instructions to a controller assembly of the well site stripper device for the collection of liquid aliphatic hydrocarbons with a dipper assembly.

In one aspect, a method for accessing a wellhead includes unsecuring a pivot element from a wellhead and removing fasteners from the first and second plates of the pivot element. The lubricator coupled to the first plate is moved apart from the wellhead as the second plate remains in communication with the wellhead.

In a further aspect, a method for retrieving a dipper assembly from within an aliphatic hydrocarbon wellbore includes pivoting a lubricator pipe away from the wellhead via the pivot element and stabilizing the lubricator pipe in an access position. The dipper assembly is drawn from within the well to the wellhead and removed away from the wellhead.

Other aspects, advantages, and novel features of the present invention will become apparent from the detailed description of the present invention when considered in conjunction with the accompanying drawings.

BRIEF DESCRIPTION OF THE DRAWINGS

The present invention is illustrated by way of example and not by limitation in the accompanying figures, in which like references indicate similar elements, and in which:

FIG. 6 illustrates one embodiment of a dipper assembly having a removable striker unit, the striker unit is shown as rendered in a fill position for sealing at least one fluid within the dipper assembly, FIG. 7 illustrates one embodiment of a dipper assembly rendered in a draw position for permitting at least one fluid to pass through the dipper assembly.

FIG. 8 is an isometric view from one end illustrating one embodiment of a dipper assembly whereby the striker unit features tabs;

FIGS. 9A and 9B generally illustrate operation of the dipper assembly, whereby FIG. 9A is an orthographic view from the side of one embodiment of a dipper assembly in the draw position as illustrated to show the dipper assembly at the downhole transition boundary between gaseous fluids and liquid fluids known as a "fluid boundary," where a valve is off-seat and the impact compensator is compressed to absorb the energy of impact with the liquid fluids while permitting the liquid to enter within the dipper assembly, and FIG. 9B is an orthographic view from the side of one embodiment of the dipper assembly of FIG. 9A in the fill position for sealing contents therein;

Generally, FIG. 12 is a exploded view from the side showing an anchoring flange apart from a wellhead and a support tray of a stripper device.

Skilled artisans appreciate that elements in the Figures are illustrated for simplicity and clarity and have not necessarily been drawn to scale. For example, the dimensions of some of the elements in the Figures may be exaggerated relative to the other elements to help improve understanding of the embodiments of the present invention.

DETAILED DESCRIPTION

For a more complete understanding of the present invention, preferred embodiments of the present invention are illustrated in the Figures Like numerals being used to refer to like and corresponding parts of the various accompanying drawings. It is to be understood that the disclosed embodiments are merely exemplary of the invention, which may be embodied in various forms.

Figures 11, 11A:
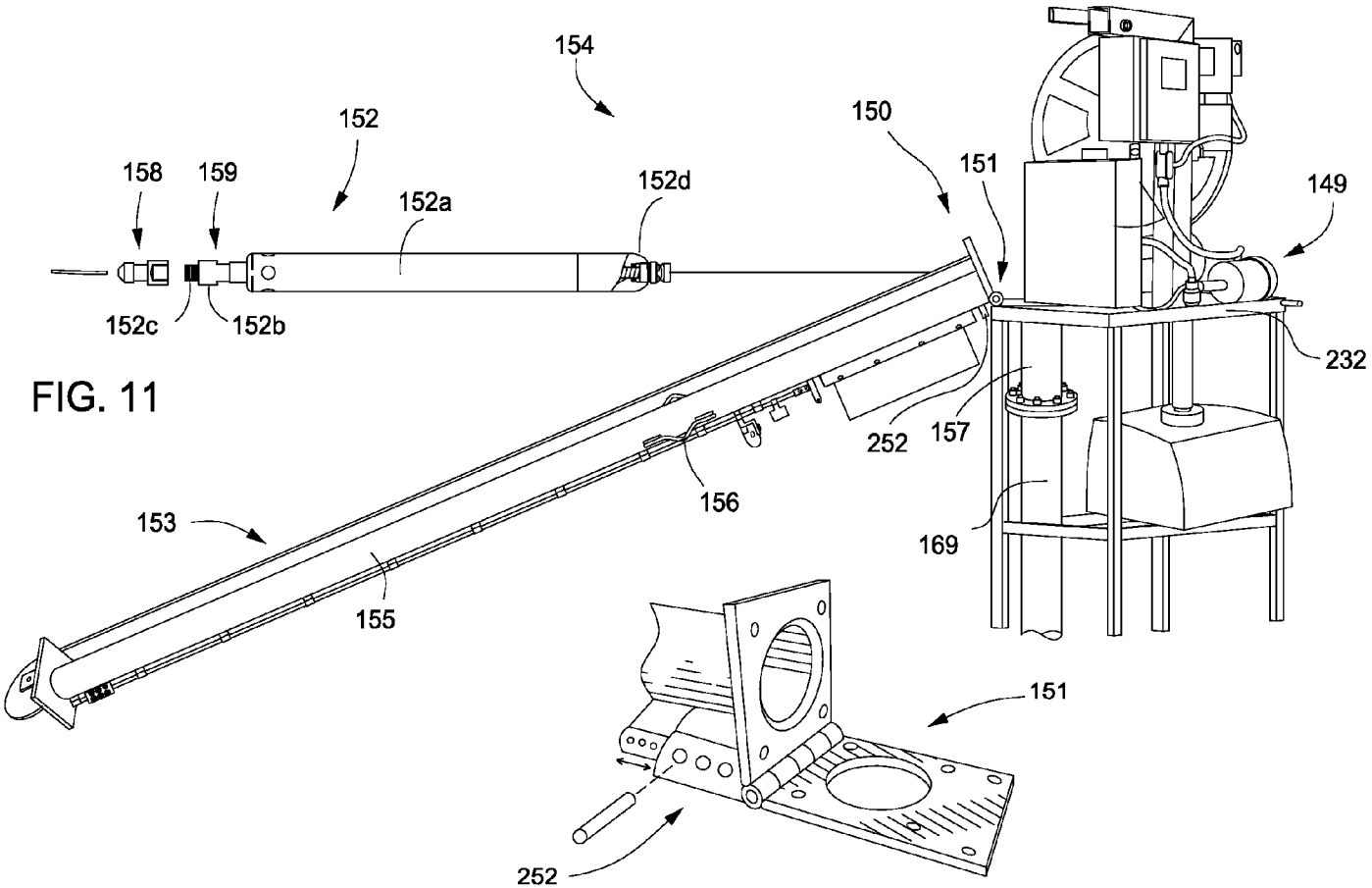
FIG. 11 is a partially exploded, isometric view illustrating one embodiment of a stripper device rendered in an access position by a pivot element, a dipper assembly is shown as removed away from a wellhead and the stripper device, the dipper assembly features a retrieval mounting portion for interchangeably receiving a variety of fishing necks assemblies of a standard type well known in the industry.
FIG. 11A is a detailed view of the pivot element featuring an adjustable alignment stopper.

FIGS. 1-2, 5-4, 11 and 13 generally illustrate at least one embodiment of a stripper device 5 for extracting aliphatic hydrocarbons from a wellhead 7 in an operational position and whereby the stripper device 5 features a recovery assembly for rendering a lubricator assembly apart from the wellhead in an access position. FIG. 11 specifically illustrates a stripper device 154 while rendered in the access position whereby a lubricator assembly 153 no longer communicates with a wellhead such that a dipper assembly 152 having an interchangeable fishing neck assembly 158 may be retrieved from the well.

Figure 7:
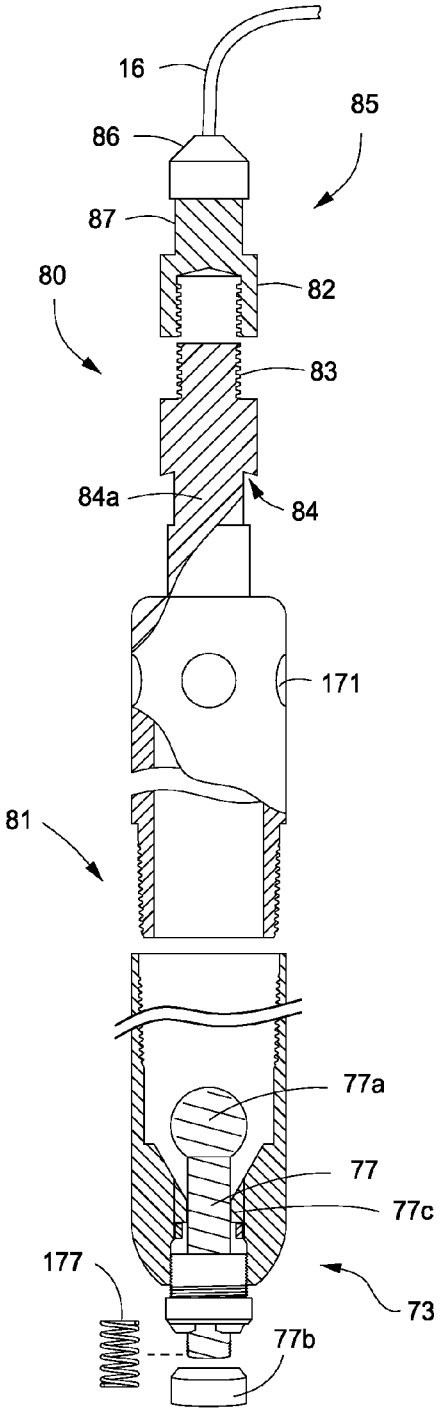
Figure 7A:
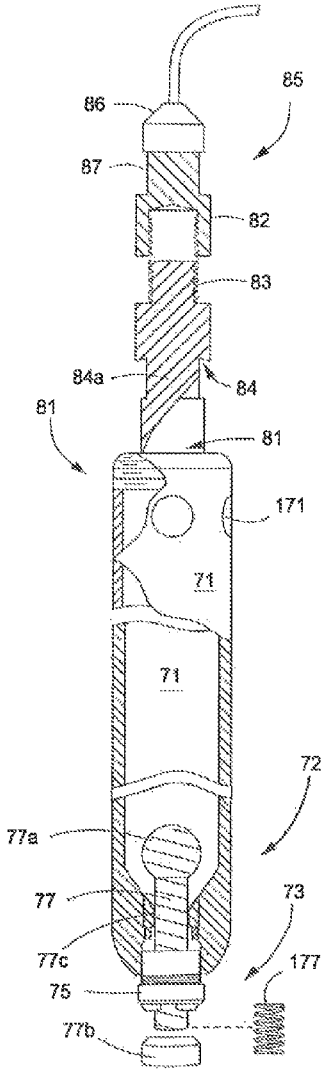
FIG. 7A illustrates one embodiment of a dipper assembly including a impact compensator for governing the rate of fluid passing through the dipper assembly.
Figure 7B:
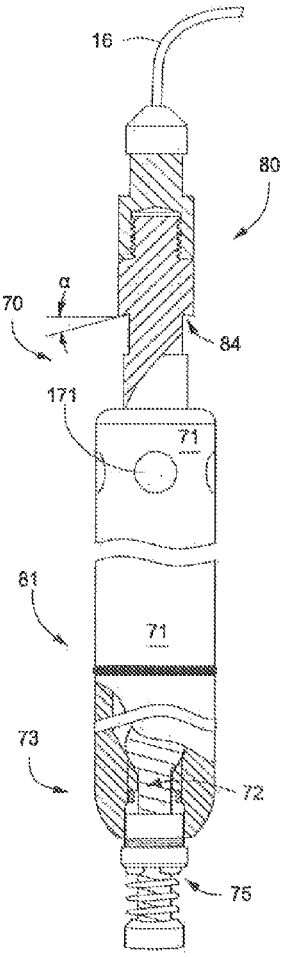
FIG. 7B shows one embodiment of a dipper assembly having a wireline tool modular interface, illustratively comprising a weld for coupling the retrieval mounting portion to the dipper body.
Figure 7C:
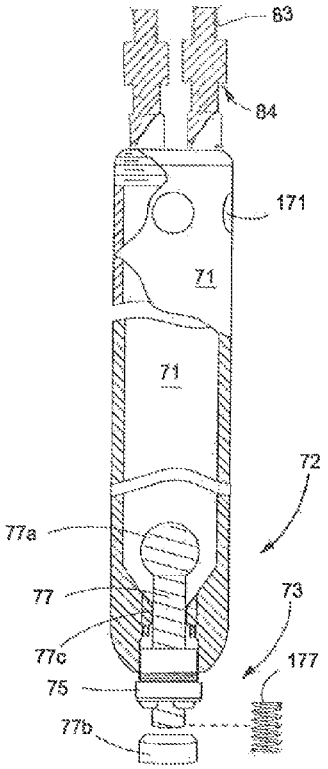
FIG. 7C shows an embodiment of a dipper assembly having a plurality of receiving pins disposed on the dipper body.

As generally shown in FIGS. 7, 7A-B, one embodiment of a dipper assembly features an interchangeable striker unit for selectively sealing aliphatic hydrocarbons therein. Illustratively, where an aliphatic hydrocarbon well primarily produces petroleum, the dipper assembly is cyclically sent downhole. Accordingly, as the dipper assembly transitions from gaseous air to column of liquids within the well, the dipper assembly impacts a downhole liquid column such that the striker unit absorbs the impact with the various liquids defining the column and opens to initiate collection of liquid nearest the fluid boundary; whereby the impact defines a condition known in the industry and defined in this disclosure and appended claims as "hitting fluid", "hit fluid" or "reaching the fluid boundary". In this manner, as the density of petroleum is less than water, the dipper assembly is assured of skimming or "dipping" at the top of a downhole liquid column whereby petroleum and other aliphatic hydrocarbons typically float atop liquid saltwater along the column.

As discussed in greater detail below in reference to FIGS. 9A and 9B, the striker unit generally includes an impact compensator 177 that resiliently compresses to absorb the forces of impact with the liquids while permitting liquid petroleum to initially enter within the dipper assembly, see FIG. 9A. Fluid thus enters initially through the striker unit and also then through a plurality of dipper ports positioned on the dipper assembly above the striker unit as the impact compensator 177 gradually returns to its normally extended position to seal the aliphatic hydrocarbons therein. The weight of the hydrocarbons contained within the dipper assembly further push out against the interior body of the dipper assembly to ensure a striker unit valve is seated to further seal the dipper assembly.

In this application, "aliphatic hydrocarbons" is a term of organic chemistry that includes petroleum and natural gas. In this disclosure and appended claims, "production well" is a marketplace term that defines a well that brings aliphatic hydrocarbons to the earth's surface for sale. In this disclosure and appended claims, the term "stripper well" is defined as a marginal aliphatic hydrocarbon production well with an average yield that is characteristically near the end of an economically useful lifespan and includes, among others, petroleum wells as well as petroleum and natural gas wells. In this application, the terms "well", "wellhead", "downhole" is defined as an aliphatic hydrocarbon production well for operative engagement with a stripper device and/or dipper assembly, including, among others, a stripper well, a petroleum well as well as petroleum and natural gas well. In this application, the term "wellbore" collectively is defined as a passage formed by the lubricator pipe, wellhead, and downhole portion of an aliphatic hydrocarbon well by which a dipper assembly traverses. In this disclosure and appended claims the term "fluid boundary" is defined as the downhole transition boundary between gaseous fluids and liquid fluids that includes liquid aliphatic hydrocarbons. Furthermore, in this application, the term "servicing" or "downhole servicing" is defined as the retrieval, repair or maintenance of downhole components associated with an aliphatic hydrocarbon well. In this application the term "dipper" is defined as a fluid container or relates to a fluid container for collecting liquid hydrocarbons in a production well as a means of production. In this application, the term "retrieval tool" refers to a general class of service equipment that is lowered downhole to collect lost or stuck equipment, for example, among others, a fishing tool and a shear pulling tool. Moreover, in this disclosure and appended claims the term processor is defined as any component or group of components, including any suitable combination of hardware and software, that is capable of carrying out any of the processes as described herein in a computer readable format. Similarly, in this application the term "memory" refers to the storage of data, instructions, and other information in a computer readable format for access by the processor.

Figure 1:
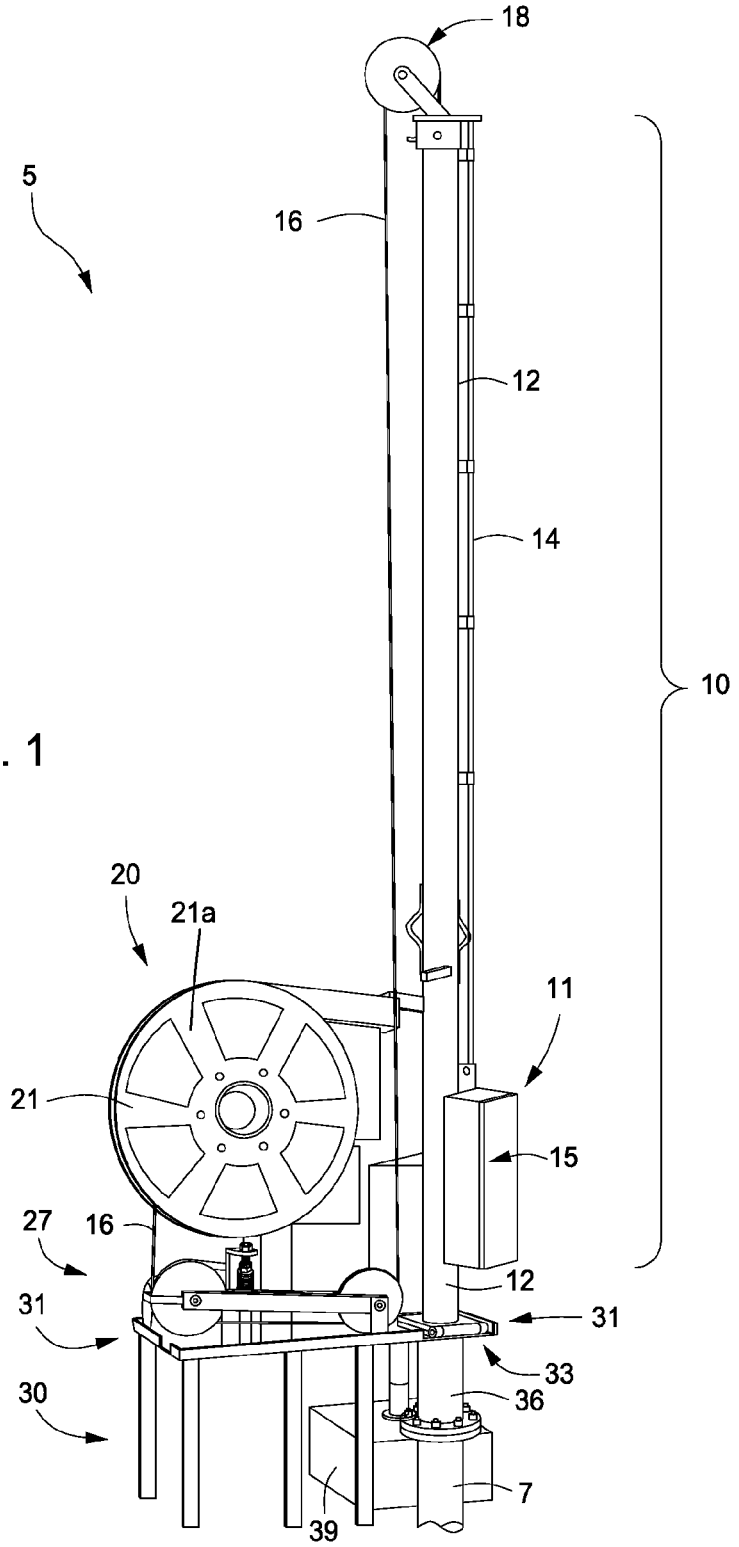
FIG. 1 is an isometric view illustrating a stripper device according to the present invention, the stripper device for use with a wellhead features a pivot element coupled to a lubricator assembly, the pivot element renders the lubricator assembly to communicate with the wellhead in an operational position and apart from the wellhead in an access position.
Figure 14:
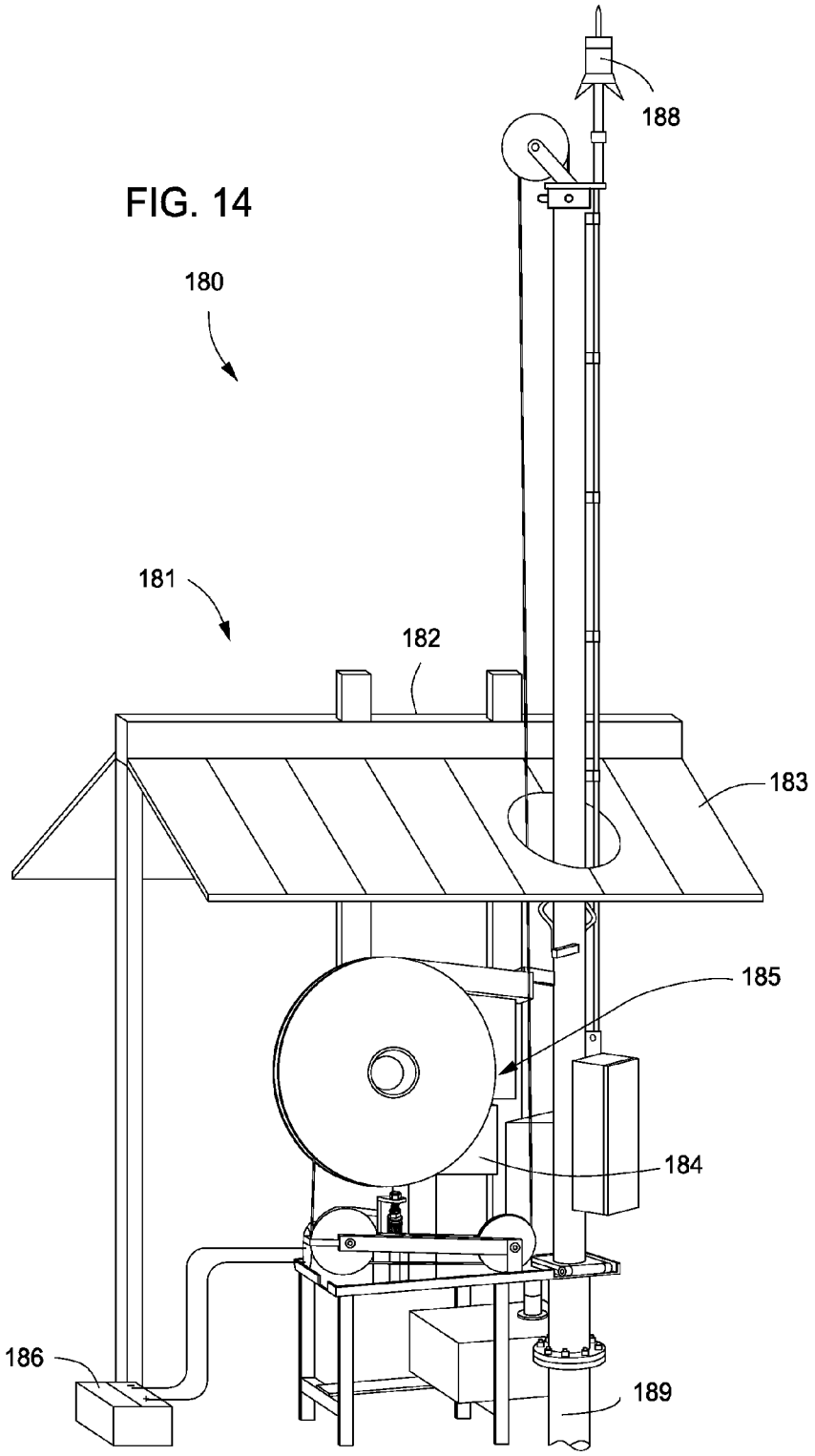
FIG. 14 is an isometric view illustrating one embodiment of an electrical power recovery system for a stripper device.

Specifically referring to FIG. 1, one embodiment of a stripper device 5 is used for drawing fluid from a wellhead of an aliphatic hydrocarbon wellhead 7 such as, among others, from the wellhead of a petroleum and natural gas well. For illustrative purposes only, this disclosure will discuss a petroleum and natural gas well as a subset of the general aliphatic hydrocarbon well by which the stripper device 5 is operatively applied to. Generally, a stripper device is applied to other aliphatic hydrocarbon wells that are readily recognizable by a person of ordinary skill in the art. Accordingly, in one embodiment, FIG. 14 illustratively shows a stripper device 5 coupled to the terminus of a petroleum wellhead 189.

Figure 2:
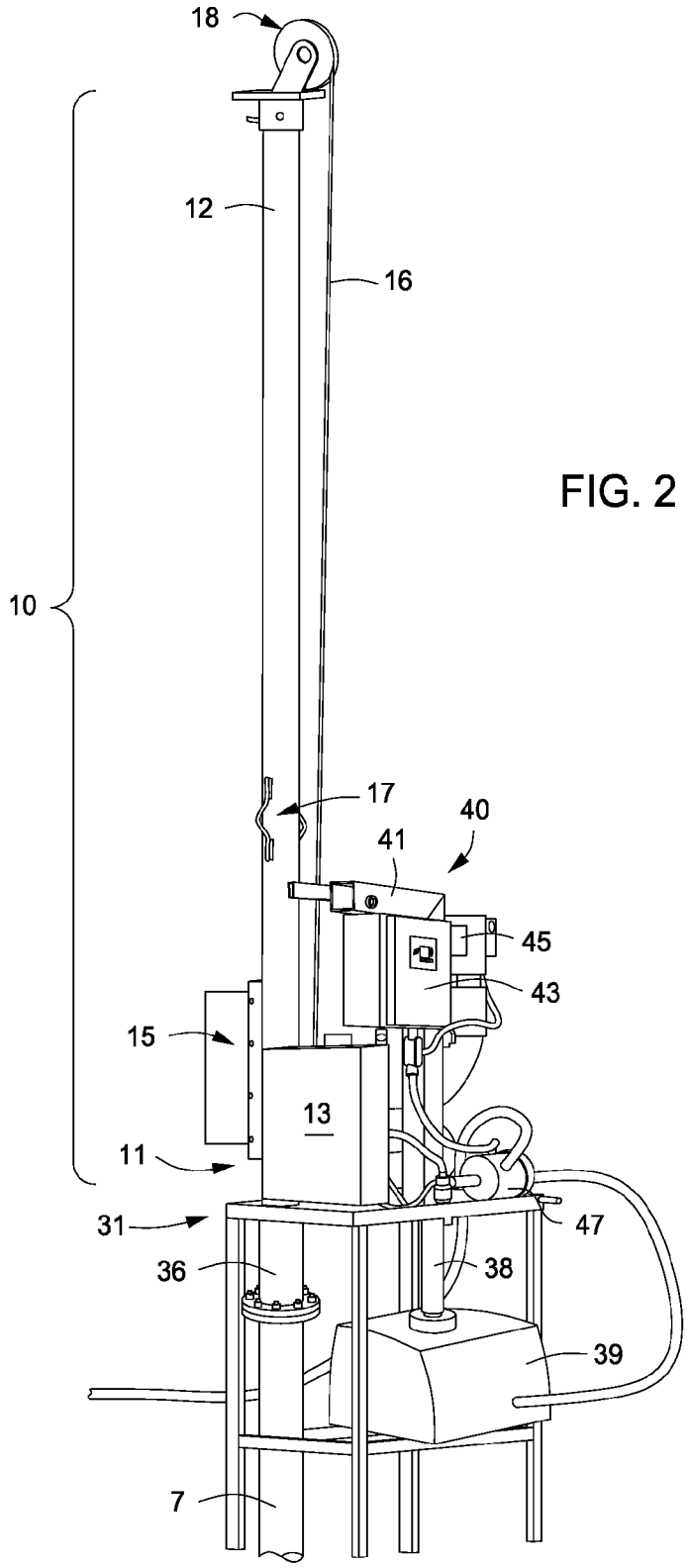
FIG. 2 is an isometric view illustrating the stripper device of FIG. 1 from an opposing perspective.

Generally, as shown in FIGS. 1-2, the stripper device 5 features a lubricator assembly 10. The lubricator assembly 10 includes a lubricator pipe 12 that communicates with the wellhead 7. In one exemplary embodiment, the lubricator pipe 12 is of a type well known in the industry fitted at the top of the wellhead 7 for assisting placement of tools into a well under pressure. Those of ordinary skill in the art will readily recognize that end-of life striper wells do not produce significantly high pressure so that the height of the lubricator pipe 12 is dependent, in part, on applying sufficient gravitational forces to operate a dump arrangement 110 as discussed below in reference to FIGS. 4 and 5.

Figure 4:
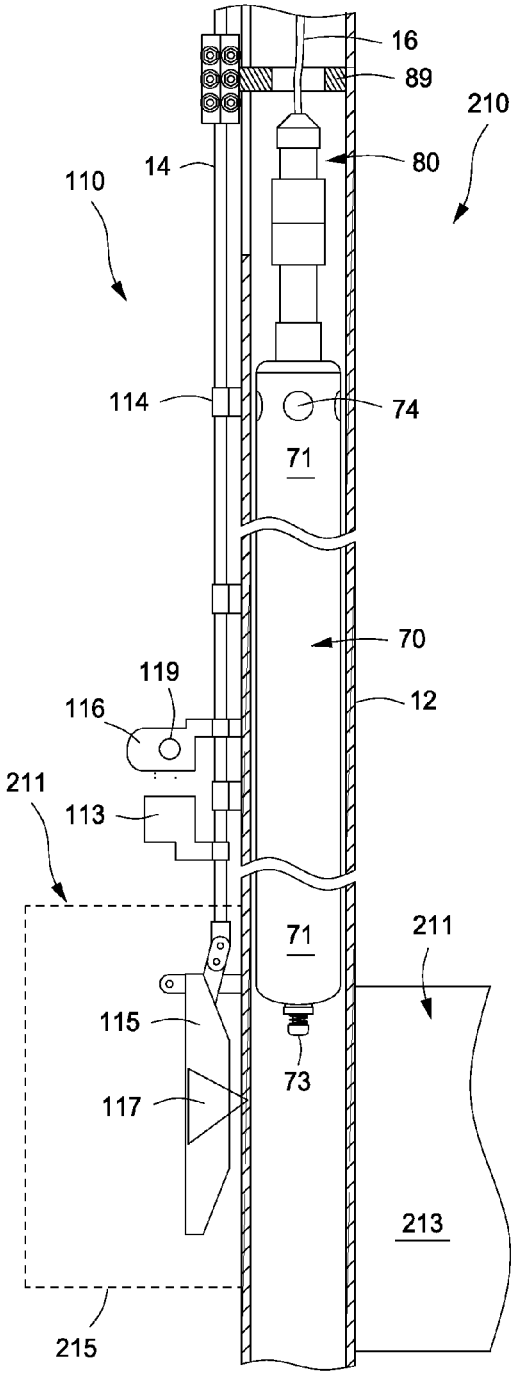
FIG. 4 is a cut-away, schematic view from the side of one embodiment of a lubricator assembly featuring a dump arrangement rendered in a collecting position, a dipper assembly with fluid therein is drawn by a wireline through a lubricator assembly toward a driver collar.
Figure 5:
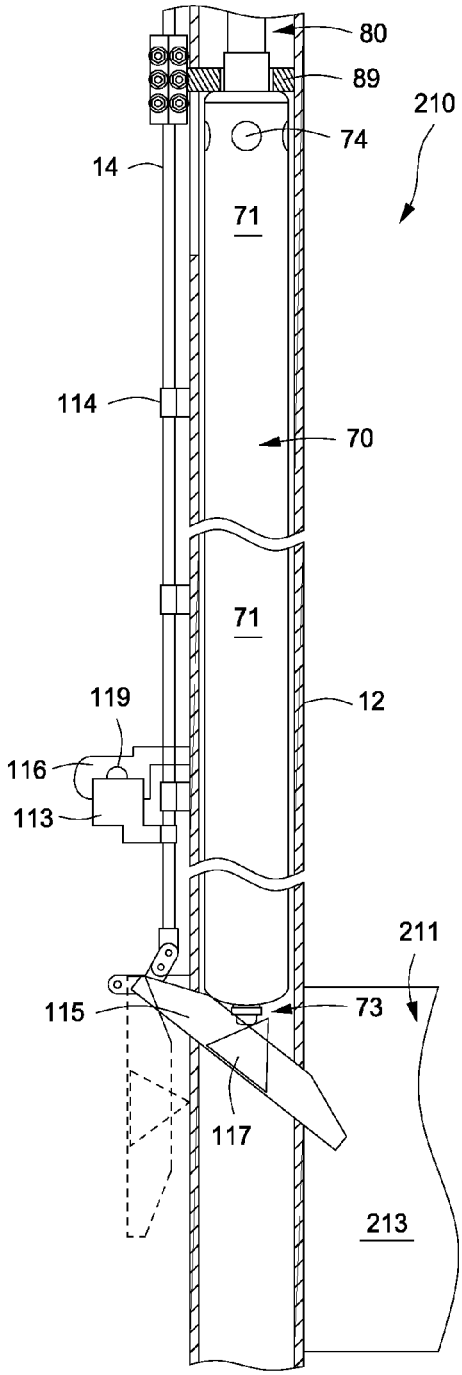
FIG. 5 is a cut-away, schematic view from the side of one embodiment of the lubricator assembly of FIG. 4 featuring the dump arrangement rendered in a dump position, fluid is drawn by gravitational forces with a striker unit from the dipper assembly to a dump manifold provided by the dump arrangement.

Referring to FIGS. 4-5, the lubricator assembly 10 further includes at least one dipper assembly 70. In operation, as discussed in greater detail below, the at least one dipper assembly 70 traverses the wellbore within the lubricator pipe 12, wellhead 7, and downhole portion of an aliphatic hydrocarbon well.

The stripper device 5 further includes a draw assembly 20. Shown in FIG. 1, the draw assembly 20 includes a reel 21 and at least one wireline 16. The wireline 16 is coupled to the reel 21 at one end and to the dipper assembly 70 at another end. In operation, the at least one dipper assembly 70 traverses the wellbore within the lubricator pipe 12, wellhead 7, and downhole portion of an aliphatic hydrocarbon well through processes implemented by a controller assembly 40 coupled to the wireline 16 and the dipper assembly 70. With specific reference to FIG. 3, a computer module 43 drives the speed of the reel 21 with a motor 44 and gear box 45 so that the wireline 16 is either variably drawn or fed through the wellbore to position the dipper assembly 70 therein. In one embodiment, the wireline 16 is TEFLON coated cable whereas in other embodiments the wireline 16 is wire rope of a type well known in the industry, for example, among others, oilfield slickline.

The draw assembly 20 includes a sheave unit 18 coupled to the lubricator pipe 12. The sheave unit 18 facilitates alignment of the wireline 16 with respect to the lubricator pipe 12 as the draw assembly 20 positions the dipper assembly 70, coupled to the wireline 16, along the wellbore. Specifically, the sheave unit 18 and a controller assembly 40 permit the reel 21 to accurately position the dipper body 71 along the wellbore. In one embodiment, as shown in FIGS. 1 and 2, the sheave unit 18 is releasably coupled to the lubricator pipe 12.

The reel 21 is composed of metallic material, such steel. Optionally, the reel 21 includes reinforcement ribs 21*a* to collectively ensure the reel's 21 structural integrity to prevent warping. In one embodiment, as shown in FIG. 1, the reinforcement ribs 21*a* are cast forged. As shown in the embodiment of FIG. 14, the reel 21 is machined.

With reference to FIGS. 2, 3, and 3A-C, the stripper device 5 further includes a controller assembly 40. The controller assembly 40 is coupled to the dipper assembly 70 via the wireline 16 of the draw assembly 20. The controller assembly 40 includes at least one processor and at least one memory and regulates the rate of collection of aliphatic hydrocarbons from the well with the dipper assembly 70.

The controller assembly 40 includes a control module 43. The control module 43 is coupled to the draw assembly 20 to regulate the rate the wireline 16 is wound for positioning the dipper assembly 70 along the wellbore. Thus, the control module 43 regulates the rate of collection of aliphatic hydrocarbons from the well with the dipper assembly 70.

The control module 43 features at least one processor device and at least one memory device. The control module 43 includes at least one program embodied on a computer readable medium and operable to be executed by the processor whereby the at least one program regulates the rate of collection of aliphatic hydrocarbons from the well with the dipper assembly 70. In one embodiment, as discussed below, the control module 43 is networked for remote operation.

The controller assembly 40 further includes a motor 44 and a gearbox 45, each coupled to the control module 43. In operation, the controller module 43 sends control signals to the gearbox 45 and the motor 44 to cooperatively drive the reel 21 thereby regulating the rate the wireline 16 is wound for positioning the dipper assembly 70 in the wellbore. Accordingly, the motor 44 and the gearbox 45 cooperatively wind the reel 21 in either a clockwise or counterclockwise manner to effectively lower or raise the dipper assembly 70 within the aliphatic hydrocarbon well.

Moreover, the control module 43 is coupled to the pump 47. In operation, the control module 43 sends signals to the pump 47 thereby regulating the rate aliphatic hydrocarbons, including petroleum, is drawn from the dump manifold 11, through the fluid drain 38, and to the collector 39.

Figure 12A:
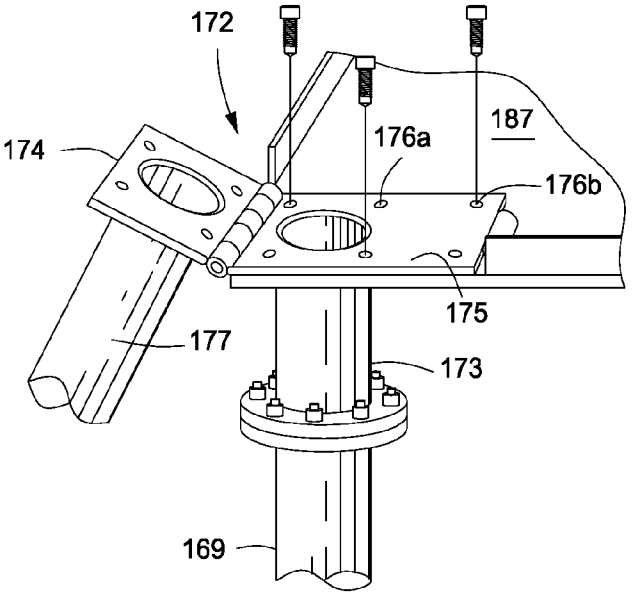
FIG. 12*a* is an isometric, partially exploded view from the side illustrating the anchoring flange coupled to the wellhead and the support tray.
Figure 12:
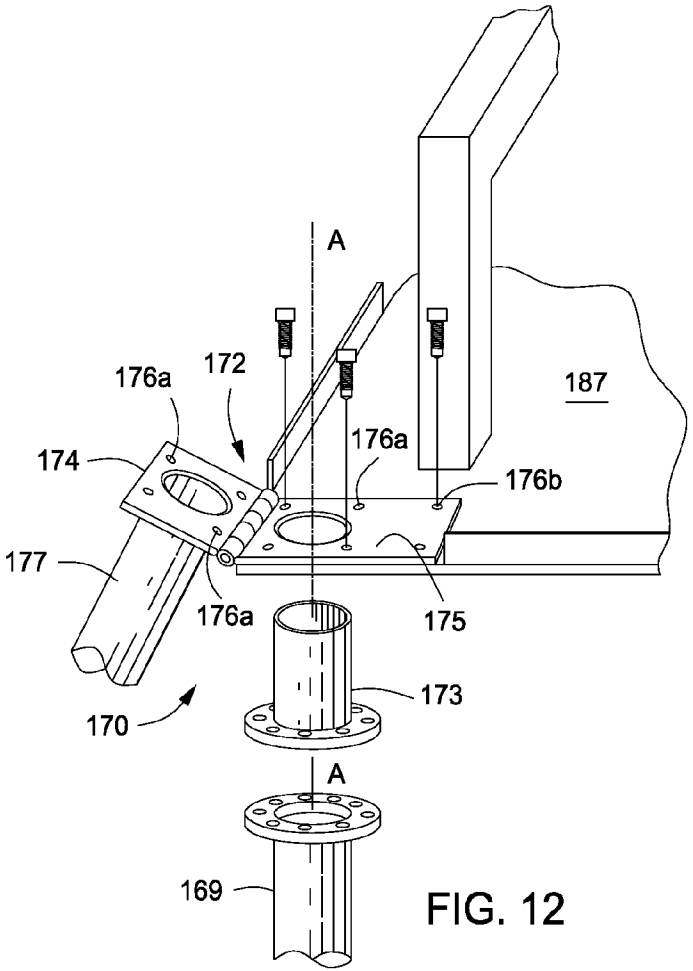
FIG. 12 illustrates one embodiment of a recovery assembly, in particular
Figure 12B:
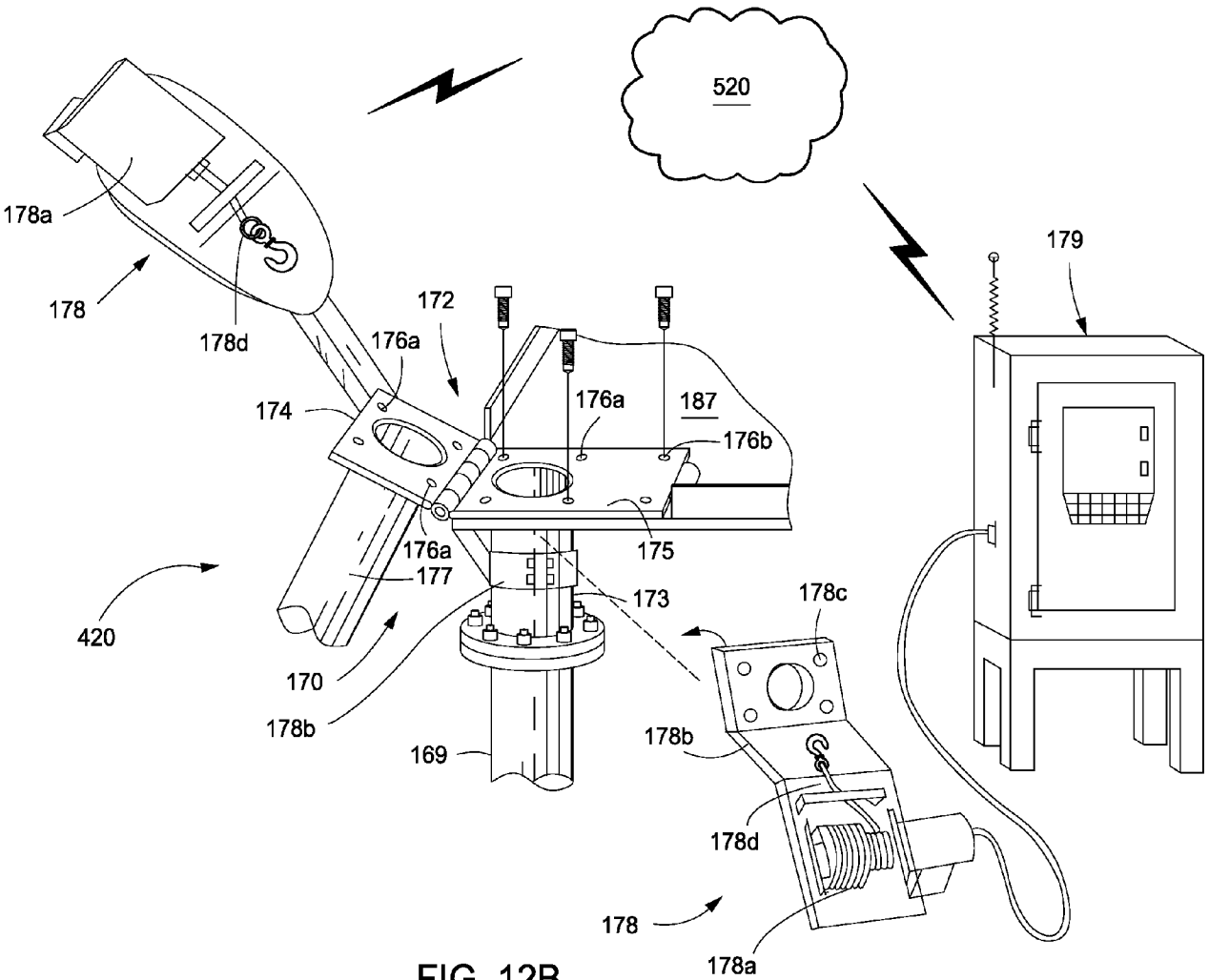
FIG. 12*b* is a schematic view illustrating a retrieval system that includes a modular winch arrangement.

Optionally, as shown in FIG. 12B, the control module 179 is coupled to a winch module 178. In operation, the control module 179 sends signals to the winch module 178 to regulate the winding rate of a service line 178*d* provided by the winch module 178 as the winch module 178 moves the service line 178 to render a lubricator assembly in either an access or operational position. FIG. 12B illustrates one embodiment of a stand-alone control module 179 coupled to a stripper device 420 and a network of stripper devices 520. The network of stripper devices 520 includes separate stripper devices from various geographical locations throughout the world.

Figure 3:
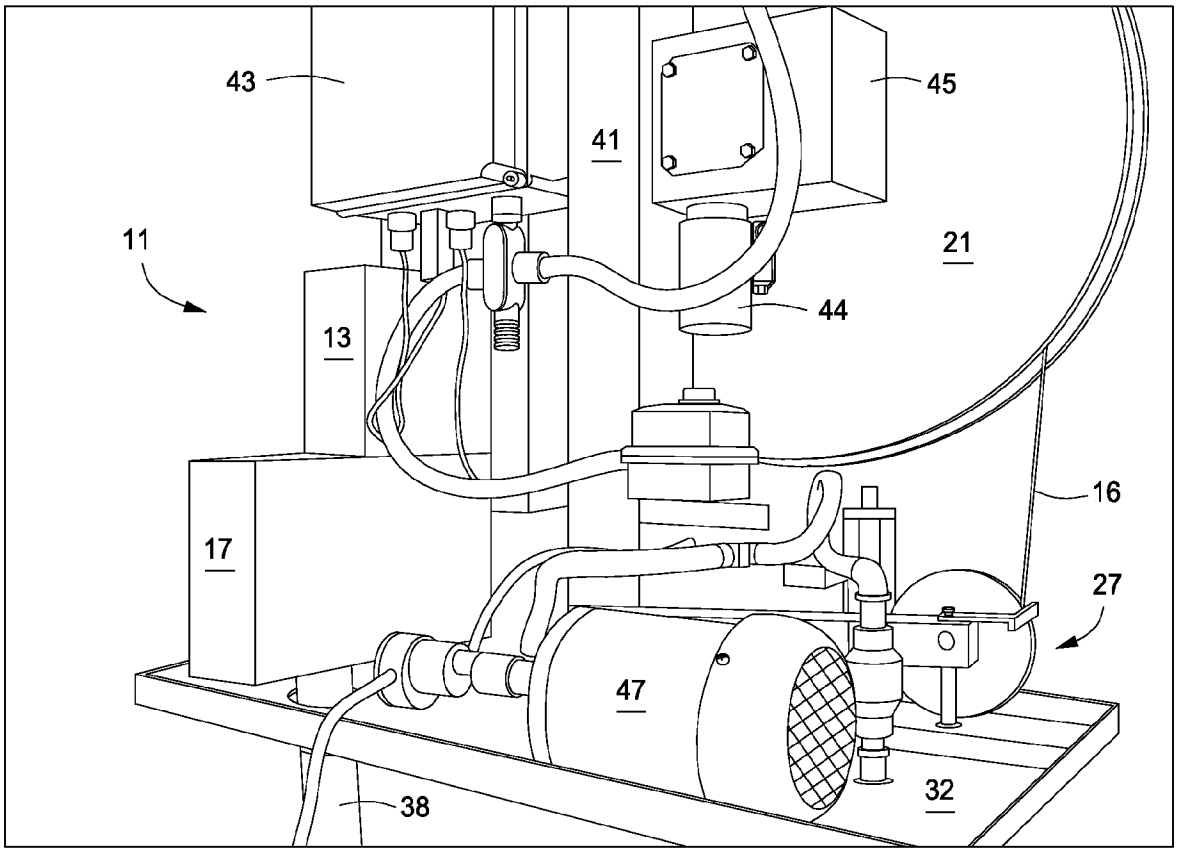
FIG. 3 is a partially detailed, isometric view from the side of one embodiment of the stripper device, the stripper device as shown generally includes at least the following.
Figure 10A:
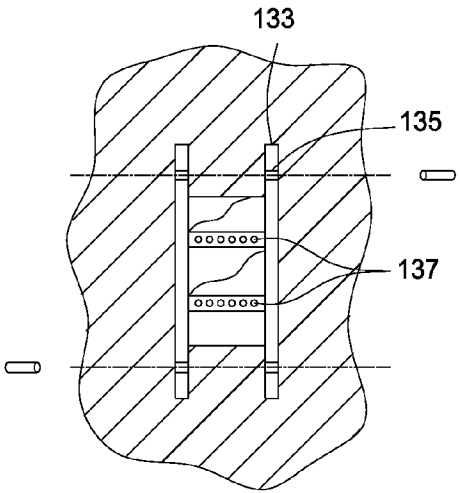
FIG. 10A is a detailed view of the quick connect interface having an electrical interface.
Figure 10:
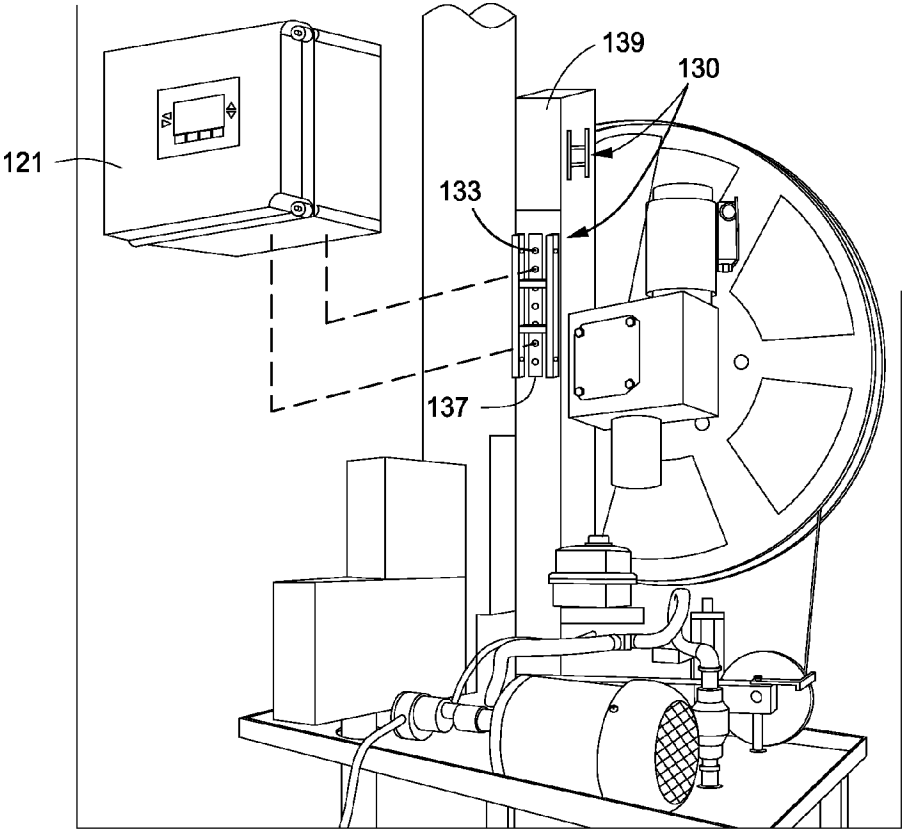
FIG. 10 is a schematic view illustrating a control module featuring a quick connect interface.

As shown in FIGS. 2, 3, and 10, the controller assembly 40 is mounted to a support frame 41. In one embodiment, the support frame 41 is coupled to a support tray 187. Those of ordinary skill in the art will readily recognize that other component assemblies comprising a stripper device can be coupled to a support frame such as, among others, a draw assembly.

Illustratively, for the embodiment of FIG. 10, the support frame 139 features a plurality of quick connect interfaces 130. Each quick connect interface 130 includes mounting members 133 for releasably coupling a component assembly of a stripper device to the support frame 139, such as, among others, a control module 121. Removable fasteners 135 couple a component assembly to a corresponding mounting member 133.

As shown, in one embodiment, the quick connect interface 130 includes an electrical interface 137 for supplying electrical power and network connectivity to a component assembly connected the mounting members 133. Those of ordinary skill in the art will readily recognize that electrical power is supplied from either an external electrical source such as, among others, an electrical grid and electric generator; a combination of an external electrical source and a stripper device battery; or directly from a combination of stripper device generators or batteries. In one embodiment, as shown in FIG. 10A, the electrical interface 137 comprises a prewired cable harness fed through tubing defining the support frame 139 whereby the cable harness includes, among others, electrical wires, coaxial cables, and audio/video cables.

Figure 13:
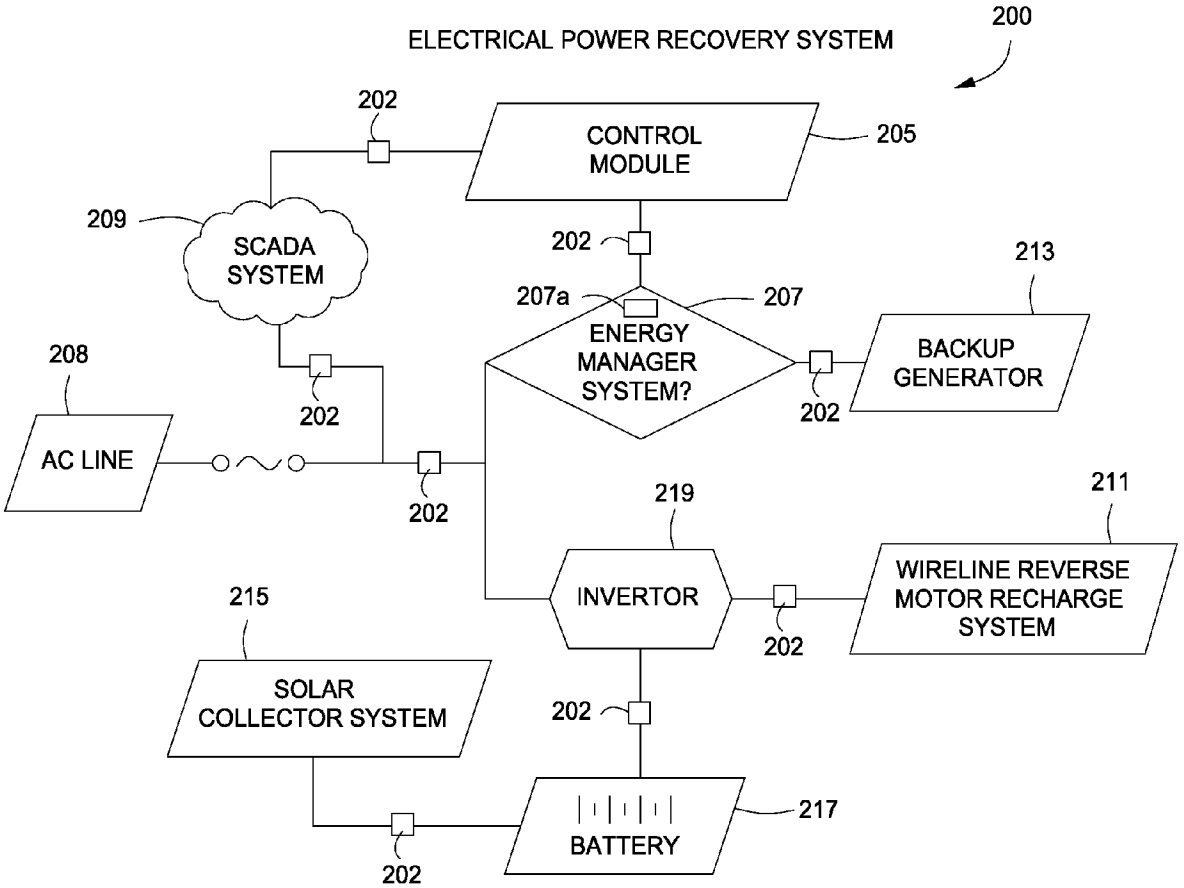
FIG. 13 is a schematic diagram illustrating one embodiment of an energy manager system for a stripper device.

As optionally as shown in FIGS. 13 and 14 and discussed in greater detail below, a controller assembly includes a battery 185 coupled to a control module. Stored electric power from the battery 185 makes operations of a stripper device either autonomous of or partially autonomous from an external electrical source, such as an electrical grid. Achieved independent operational efficiency facilitates aliphatic hydrocarbon production operations with a stripper device in remote locations lacking in or with limited external energy supply.

As such, the controller assembly 40 further includes an energy manager system 205 coupled to the control module 43 and to the battery 185. The energy manager system 205 is a combination of hardware and software components for regulating the storage of electrical power during production operations for aliphatic hydrocarbons from a well with a dipper assembly.

Referring to FIG. 3, the control module 43 is further coupled a fluid indicator 27. In operation, for each trip down the wellbore, the fluid indicator 27 determines the depth at which a dipper assembly hits fluid. Illustratively, in either a petroleum or a petroleum and natural gas well, the fluid indicator 24 determines the depth of the fluid boundary in the well between a gaseous air mixture and a liquid column that includes liquid aliphatic hydrocarbons and liquid saltwater, whereby typically petroleum with a characteristically lighter density floats atop liquid salt water and other liquids in the liquid column with a characteristically heavier density. Operatively, the control module 43 receives the fluid boundary depth from the fluid indicator 27 and, based on such depth, calibrates subsequent collections of a dipper assembly to ensure a greater probability of collecting petroleum rather than water and other non-aliphatic hydrocarbons. Moreover, the control module 43 is configured to make corrections to the dipper assembly's downhole position if the location of the fluid boundary changes as nearby debris and earth accumulates in the wellbore.

Figure 3A:
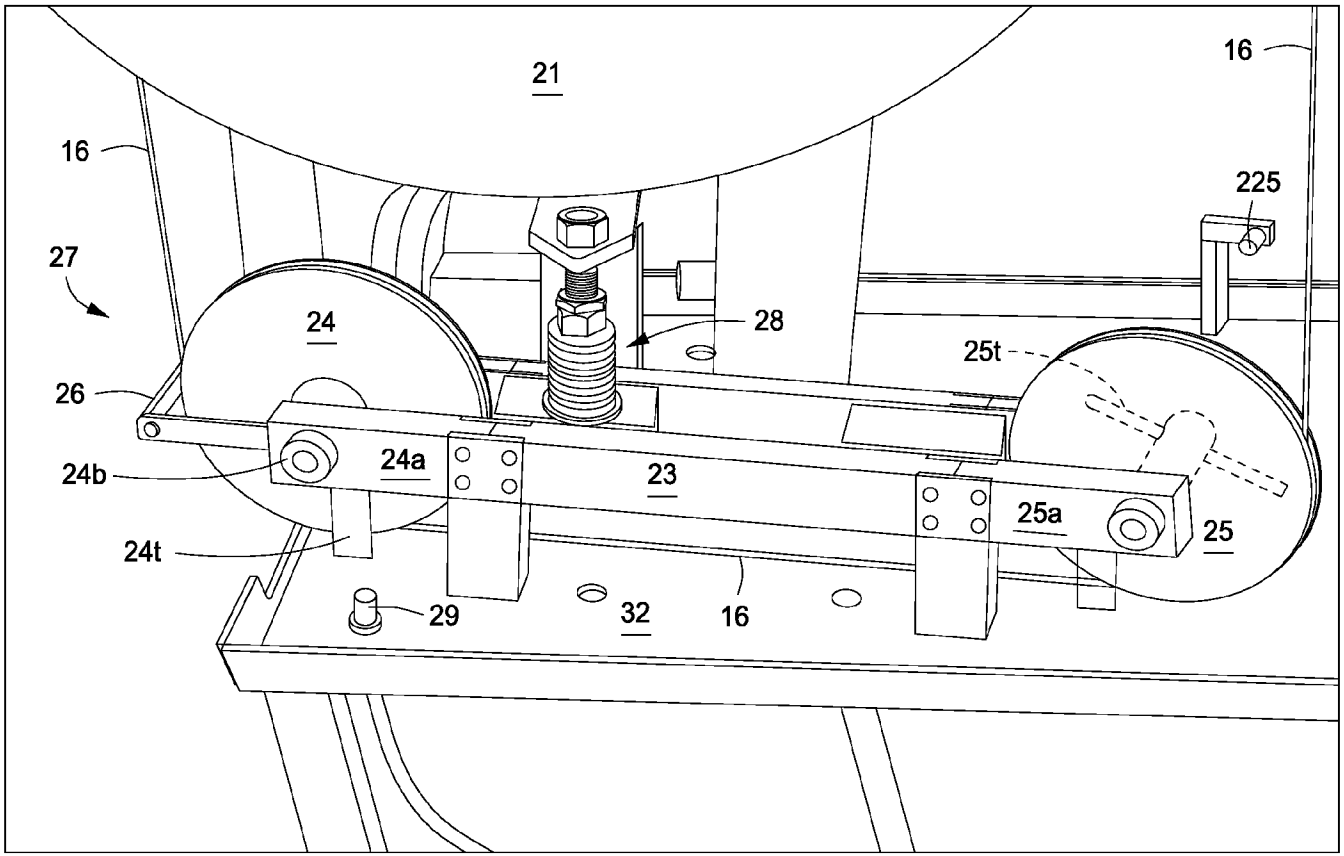
FIG. 3A illustrates one embodiment of a fluid indicator featuring a fluid level sensor.
Figure 3B:
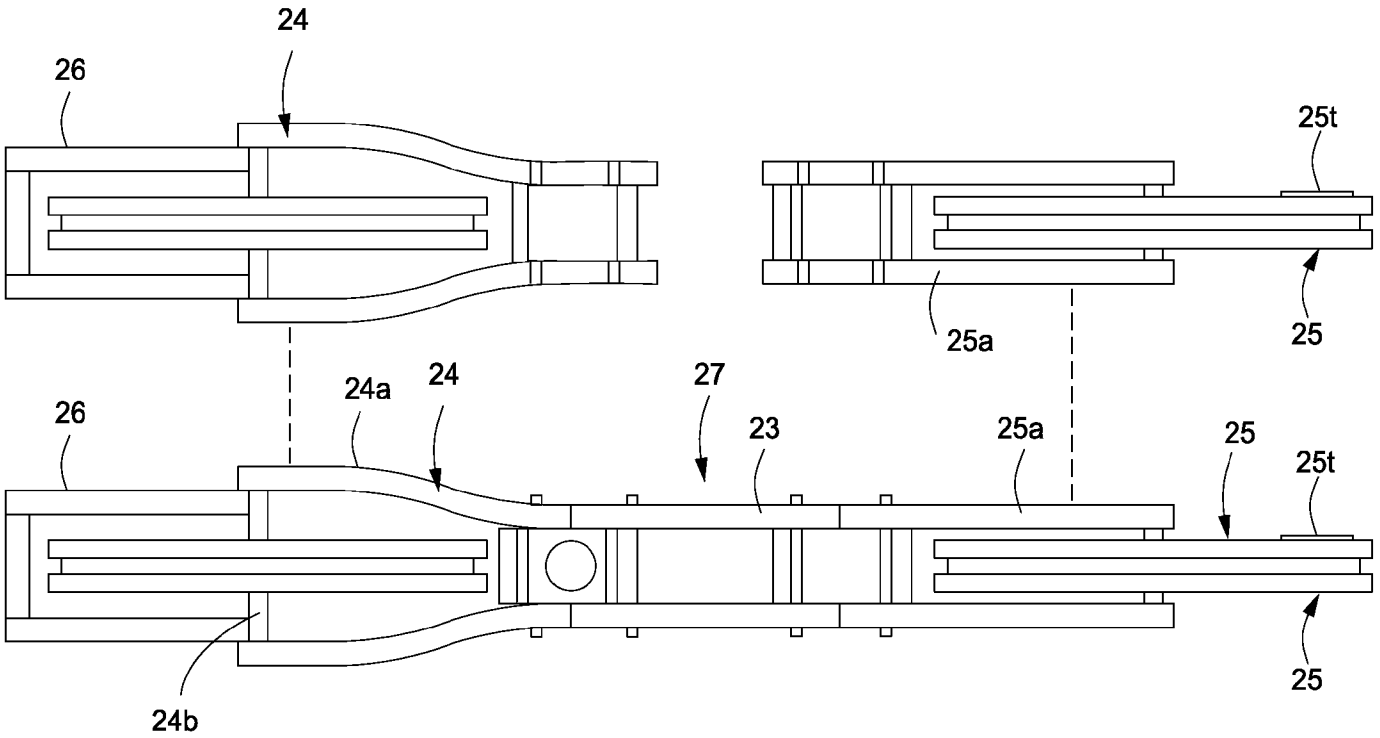
FIG. 3B illustrates one embodiment, as exploded, of a fluid indicator featuring either interchangeable or replaceable gliding and counter wheels.
Figure 3C:
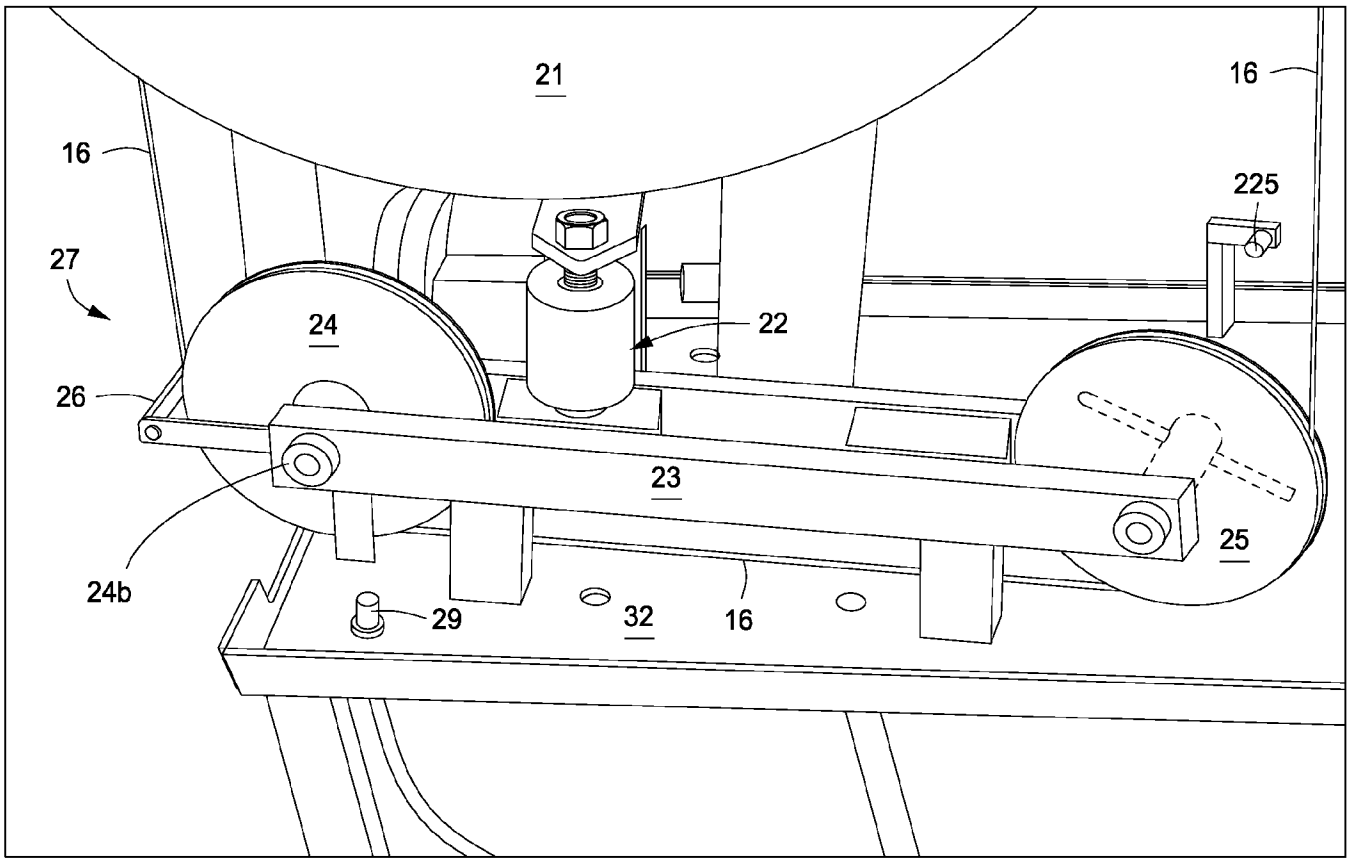
FIG. 3C illustrates one embodiment of a fluid indicator featuring a quantity indicator.

Specifically, FIGS. 3, 3A, and 3C show the fluid indicator 27 coupled to the wireline 16. The wireline 16 is operatively wound about a circuitous path between a downhole dipper assembly at one end and a reel 21 at an opposing end. In particular, the wireline 16 extends from the reel 21; to the fluid indicator 27, namely through a gliding wheel 24 and a counter wheel 25; across the lubricator assembly 10 at the sheave unit 18; through the wellhead; down the wellbore; and to the dipper assembly 70.

Moreover, in one embodiment, the fluid indicator 27 is coupled to the support tray 32. To operatively engage the fluid indicator 27 once coupled to the stripper device 5, the wireline 16 feeds through the guide wheel 24 and counter wheel 25 in the circuitous path described above. In one embodiment, the fluid indicator 27 is configured to be modular such that the fluid indicator 27 is releasably coupled to the stripper device 5.

Referring to FIG. 3A, the fluid indicator 27 includes a rocker arm 23. The fluid indicator 27 further includes a gliding wheel 24 coupled at one end of the rocker arm 23 and to the wireline 16. The fluid indicator 27 further includes a counter wheel 25 coupled to the wireline 16 and to an end of the rocker arm 23 that opposes the gliding wheel 24. The fluid indicator 27 operatively determines when a dipper assembly hits fluid downhole with the gliding wheel 24 as well as the depth along the wellbore at which the dipper assembly hits fluid with the counter wheel 25. Those of ordinary skill in the art will readily recognize other methods for determining the downhole fluid boundary for each trip that the dipper assembly makes within the aliphatic hydrocarbon well.

For the embodiment of FIG. 3A, the gliding wheel 24 and the counter wheel 25 each comprise a sheave. The reel 21 operatively feeds the wireline 16 through the grooves of each sheave defining the gliding and counter wheels 24, 25 during the cyclical production operations of collecting hydrocarbons from downhole with the dipper assembly 70.

Referring to FIGS. 3A and 3B, the gliding wheel 24 includes a frame 24*a*. The frame 24*a* provides a shaft 24*b* for the gliding wheel 24 to traverse along or "float". Operatively, the gliding wheel 24 traverses along the shaft 24*b* to prevent the wireline 16 from entangling as the reel 21 turns.

The gliding wheel 24 further includes wire feedguide 26. The wire feedguide 26 operatively establishes a small gap between the body of the wire feedguide 26 and the groove of the sheave that comprises the gliding wheel 24 to ensure continuous placement of the wireline 16 on the groove.

The fluid indicator 27 further includes a fluid level sensor 29 positioned adjacent to and in operative engagement with the gliding wheel 24 to identify when the dipper assembly 70 hits the fluid boundary within an aliphatic hydrocarbon well, such as a petroleum well. The fluid level sensor 29 is coupled to the control module 43 for identifying the fluid boundary with data from the fluid level sensor 29. In one embodiment, the fluid level sensor 29 comprises a proximity sensor.

Illustratively, the instantaneous slack exerted across the wireline 16, as the attached dipper assembly hits fluid, consequentially displaces the gliding wheel 24 such that the resulting jarring motion due to loss of wireline tension exerted on the associated gliding wheel frame 24*a* triggers the fluid level sensor 29. The fluid level sensor 29 measures displacement of the gliding wheel 24 to identify the fluid boundary within the aliphatic hydrocarbon well.

Illustratively, in the embodiment of FIG. 3A, the frame 24*a* provides a fluid level target portion 24*t*. As a dipper assembly 70 hits fluid, the dipper body 71 travels from a gaseous air mixture to a liquid column having a significantly greater density than the gas such that the resistive liquid fluids at the fluid boundary generate a jolting force that acts against the dipper assembly 70 and wireline 16. Accordingly, the fluid level target portion 24*t* is jarringly forced toward the fluid level sensor 29 that is disposed on the support tray 32 at a predetermined distance to thus trigger the sensor 29 to indicate that the dipper assembly has arrived at the fluid boundary for this individual downhole pass. Accordingly, in one embodiment, the sensor 29 sends at least one "hit fluid" signal to the control module 43 for processing thereof.

In one embodiment, the fluid indicator 27 provides an indicator damper 28 coupled to gliding wheel 24. In operation, the indicator damper 28 modulates displacement exerted by the jarring gliding wheel 24 and frame 24*a* for each time the dipper assembly hits fluid. The displacement modulation is calibrated to operate with the type of fluid level sensor 29 employed by the fluid indicator 27.

Referring to FIGS. 3A, 3B, and 3C, the counter wheel 25 is coupled to counter frame 25*a* and a depth gauge. The depth gauge is coupled to the wireline 16 and the control module 43. The depth gauge measures the depth of a dipper assembly within an aliphatic hydrocarbon well relative to the stripper device 5. In one embodiment, the depth gauge continuously measures the depth of the dipper assembly.

As shown, the depth gauge in one embodiment includes a counter 225 and a counter target 25*t* that is coupled to the counter wheel 25. As the dipper assembly traverses the wellbore, the wireline 16 operatively turns the counter wheel 25. A stripper device controller assembly coupled to the counter 225 determines the linear distance traveled by the dipper assembly along the wellbore by counting the trigger signals generated between the counter 225 and the counter target 25*t*. In one embodiment, trigger signals are generated between the stationary counter 225 and the revolving counter target 25*t* as the counter target 25*t* travels in tandem with the counter wheel 25. Illustratively, for the embodiment of FIG. 3A, the counter target 25*t* comprises a key whereas for the embodiment of FIG. 3C the counter target 25*t* comprises a laminate disposed on the sheave defining the counter wheel 25. The trigger signals are sent by the counter 225 to the control module 43 for processing.

Referring to the embodiment of FIG. 3C, the fluid indicator 27 further includes a quantity indicator 22 coupled to the wireline 16 and the control module 43. The quantity indicator 22 measures the tension exerted by the wireline 16 to determine the amount of desired fluid within the dipper assembly coupled to the wireline 16 based on the net weight of the contents in a dipper assembly and the known density of a desired fluid.

In one embodiment, the quantity indicator 22 measures the amount of tension across the wireline 16 to provide data to the controller assembly 40. The controller assembly 40 determines the amount of desired fluid within the dipper assembly coupled to the wireline 16 based on the net weight of the contents in the dipper assembly and the predetermined density of the desired fluid stored in the at least one memory. The predetermined density of the desired fluid, in one embodiment, is based on past collections of the desired fluid by the dipper assembly that is stored in the at least one memory. Accordingly, the at least one memory is coupled to a control system for the stripper device. In particular, the control system includes a controller assembly provided by the stripper device and linked to a SCADA controller. The at least one memory of the controller assembly provides information to the SCADA controller that is related to the quantity of desired fluid collected by a dipper assembly of the stripper device, such as, among others, the quantity of liquid petroleum.

Illustratively, the quantity indicator 22 comprises a load cell. In one embodiment, the quantity indicator 22 comprises a mechanical diaphragm. The displacement measured by the quantity indicator 22 is used by a control module 43 of the controller assembly to determine the weight of specific contents sealed within a dipper assembly of a fixed volume and weight that is retrieved from downhole. Accordingly, the control module 43 includes density tables of various aliphatic hydrocarbons drawn from a particular well that are stored in a computer readable memory and thus calculates the amount of a desired fluid drawn from the well, such as, among others, the ratio of petroleum to salt water, based on the net weight of fluids drawn from a hydrocarbon well by the dipper assembly.

In one embodiment, based on the data received from the counter 225, the fluid level sensor 29, and the quantity indicator 22, the control module 43 each trend various metrics. Illustratively, these metrics include, among others, the average depth of the fluid boundary for each well, a rate by which the dipper assembly collects of aliphatic hydrocarbons from a specific stripper well without overworking that well, and the amount of a particular aliphatic hydrocarbon collected by a dipper assembly for each downhole trip.

In one embodiment as shown in FIG. 3B, to facilitate ease of servicing and manufacturing, the guide wheel 24 and the counter wheel 25 each maintain the same size configuration with respect to one another. Moreover, as shown in FIG. 3B, guide wheel 24 and the counter wheel 25 each feature corresponding support frames 24*a* and 25*b*. Each corresponding support frame 24*a* and 25*b* couples with the rocker arm 23. Specifically, in one embodiment, each support frame 24*a*, 25*a* is releasable from the rocker arm 23 to facilitate ease of servicing and manufacturing.

Referring now to FIG. 1, the stripper device 5 includes a dump manifold 11. The dump manifold 11 includes a dump actuator 15 and at least one dump processing reservoir 13. In the embodiment of FIG. 4, a dump actuator 215 includes a flapper 115 and a strike point 117.

The dump manifold 11 of FIG. 1 is in operative engagement with the dipper assembly 70 and receives hydrocarbon fluids from the dipper assembly 70. As shown in FIGS. 1-2, and 3, the aliphatic hydrocarbons in at least one embodiment are collected from the dipper assembly 70 and directed through at least one dump processing reservoir 13, across a fluid drain 38, to a collector 39, via a pump 47. The collector 39 is in fluid communication with the dump manifold 11 to prevent the hydrocarbons from escaping to the surrounding environment. From the collector 39, the hydrocarbon fluids may be directed to a gun barrel and storage tank battery in preparation for future refinement. For the embodiment of FIG. 3, the dump manifold 11 collects aliphatic hydrocarbon fluids from the dipper assembly 70 and initially applies gravitational forces to direct the hydrocarbons and other fluids from the liquid column collected within the dipper assembly 70 through a first dump processing reservoir 13 and a second dump processing reservoir 17.

The dump manifold 11 includes a dump actuator 15. For the embodiment of FIG. 1, the dump actuator 15 is coupled to the lubricator pipe 12 and selectively opens the dipper assembly 70, via an actuator rod 14 provided by the lubricator assembly 10, to receive fluids from the dipper assembly 70.

Specifically, referring now to FIGS. 4 and 5, the actuator rod 14 selectively opens the dipper assembly 70 as follows. In FIG. 4, a dump arrangement 110 is collectively provided by a lubricator assembly 210 and a dump manifold 211. The dump manifold 211 includes a dump actuator 215 and at least one dump processing reservoir 213. The lubricator assembly 210 includes a lubricator pipe 12, an actuator rod 14, a driver collar 89, a target element 113 coupled to the actuator rod 14, and a proximity sensor switch 119 as well as a corresponding a sensor support 116 both coupled to the lubricator pipe 12.

FIG. 4 shows the dump arrangement 110 rendered in a collecting position. Accordingly, a dipper assembly 70 containing at least one fluid therein is drawn by a wireline 16 toward a driver collar 89. In the collecting position, the flapper 115 provided by the dump actuator 215 and is aligned substantially parallel with the actuator rod 14 and the lubricator pipe 12 of the lubricator assembly 210.

FIG. 5 illustrates the lubricator assembly 210 of FIG. 4 featuring the dump arrangement 110 rendering toward a dump position. As the dipper assembly 70 contacts the driver collar 89, the flapper 115 coupled to the driver collar 89 is urged by the actuator rod 14 toward the dipper assembly 70 by the dump arrangement 110 at an angle relative to the lubricator pipe 12. In the dump position, the flapper 115 contacts a striker unit 73 to ultimately unseat a collection valve to draw fluid from the dipper assembly 70 to at least one dump processing reservoir 213 provided by the dump manifold 11.

Optionally, the dump actuator 215 includes a strike point 117 coupled to the flapper 115 for ensuring direct contact with the striker unit 73. As shown in FIGS. 4 and 5, in at least one embodiment, the strike point 117 is configured as a wedge to ensure substantially perpendicular contact with the striker unit 73.

In comparing FIG. 4 with FIG. 5, as the dipper assembly 70 operatively contacts the driver collar 89, the driver collar 89, coupled to the actuator rod 14 at the exterior surface of the lubricator pipe 12, moves the actuator rod 14 toward the sheave unit 18 in tandem with the dipper assembly 70. Accordingly, a target element 113 mounted to the moving actuator rod 14 is directed to intersect and thus engage a proximity sensor 119 adjustably disposed on a sensor support 116 that is fixed to the exterior surface of the lubricator pipe 12 at a predetermined position. To ensure proper alignment with the proximity sensor 119, the moving actuator rod 14 is directed through a plurality of linkage supports 114 mounted on the exterior surface of the lubricator pipe 12.

Operatively, to engage the flapper 115 as the dipper assembly 70 contacts the driver collar 89, the proximity sensor 119 sends a signal to a control module 43 to stop the motor 44 for driving the reel 21 and thus stopping further movement of the wireline 16 and coupled dipper assembly 70. In one embodiment, the proximity sensor signal stops the motor 44 so that the dipper assembly 70 subsequently comes to rest within the lubricator pipe 12 at a predetermined distance while engaging the flapper 115.

In operation, the flapper 115 and, optionally, the strike point 117 open the sealed dipper assembly 70. In one embodiment, the flapper 115 is configured in a U-shaped profile, such as, among others, a channel-like shape or a flume shape. The flapper 115 then directs the flow of liquid hydrocarbons exiting the striker unit 73 of the dipper assembly 70 to the at least one dump processing reservoir 213. The liquid hydrocarbons are then pumped from the at least one dump processing reservoir 213 through the fluid drain 38 to the collector 39.

Referring now to FIGS. 1, 11, and 12, the stripper device further includes a recovery assembly 31. In general, the recovery assembly 31 facilitates ease of servicing of a stripper device, for example, among others, servicing a stripper device in remote locations with limited resources.

The recovery assembly 31 includes a pivot element 33. The pivot element 33 is coupled to a lubricator assembly 10 and to the wellhead 7 via a support tray 32. In general, the pivot element 33 operatively renders the lubricator pipe 12 of the lubricator assembly 10 to communicate with the wellhead 7 in a first position and renders the lubricator pipe 12 apart from the wellhead 7 in a second position. In the second position, the lubricator pipe 12 is positioned such that the dipper assembly may be retrieved from downhole and removed away from the wellhead 7. Generally, the wellhead 7 is that of an aliphatic hydrocarbon well, such as among others a petroleum well, a natural gas well, and a petroleum and natural gas well. In one embodiment, the lubricator pipe 12 in the second position is stabilized to a defined position whereby the dipper assembly may be retrieved from downhole and removed away from the wellhead 7.

In one embodiment, the pivot element 33 is releasably coupled to the support tray 32. Operatively, the support tray 32 facilitates anchoring the pivot element 32 and lubricator assembly 10 to the wellhead 7. Moreover, the support tray 32 provides a support framework for various component systems defining the stripper device 5, such as, among others, a draw assembly, a fluid indicator, a dump manifold, and a controller assembly.

In one embodiment the support tray 32 is coupled to the anchoring flange 36 while in another embodiment the support tray 32 is integral with the anchoring flange 36. The support tray 32 in one embodiment comprises a plate with a lip formed substantially about the periphery. The lip operatively retains residual fluids from the wellbore including hydrocarbon fluids, such as petroleum, that seep downward from the dump manifold 11 to the support tray 32.

Illustratively, the pivot element 172 of FIGS. 12, 12A, 12B, and 12C includes a first plate 174 coupled to a second plate 175. The first plate 174 is coupled to a lubricator pipe 177 whereas the second plate 175 is aligned with the centerline A-A of a wellhead 173 and releasably anchored to the support tray 187 via fasteners as shown in FIG. 12. In another embodiment, the second plate 175 is fixedly coupled to the support tray 187, such as with welds. For illustrative purposes, the pivot point coupling the first and second plates 174, 175 is defined as a hinge although those of ordinary skill in the art will readily recognize other suitable pivot points that provide up to six degrees of freedom, such as, among others, a ball and socket and a swivel.

In one embodiment, as shown in FIG. 12A, the first and second plates 174, 175 each define lubricator mounts 176*a*. As the surfaces of first and second plates 174 and 175 mate while the lubricator pipe 177 is rendered in an operational position, each lubricator mount 176*a* from each plate 174, 175 collectively forms at least one continuous passageway through the folded pivot element 172 for receiving a respective fastener therethrough. Specifically, in one embodiment, the support tray 187 defines bores (not shown) that respectively align with each continuous passageway defined by the lubricator mounts 176*a* for securedly receiving the fasteners fed from the lubricator mounts 176*a* therethrough to, at least in part, secure the lubricator assembly to the support tray 187.

Alternatively, while rendered in an access position, the lubricator pipe 177 is separated from the wellhead 169 by removing the fasteners from the corresponding lubricator mounts 176*a* and separating the first plate 174 from the second plate 175. Thus, while in the access position, downhole entry is achieved without the added condition of either entirely removing the lubricator pipe 177 or stripper device from the wellhead 169.

In one alternative embodiment, the second plate 175 further defines wellhead mounts 176*b*. Each wellhead mount 176*b* receives a corresponding fastener to releasably couple the pivot element 172 to the support tray 187. While in the access position, the removal of the lubricator pipe 177 entirely from the associated stripper device is quickly achieved by removing fasteners from the pivot element 172 at both the wellhead mounts 176*b* as well as the lubricator mounts 176*a*. Otherwise, while in the access position, the lubricator pipe 177 will remain fastened to the support tray 187 at the wellhead mounts 176*b* despite removing fasteners at the lubricator mounts 176*a* to gain access to the wellhead 169.

FIG. 12B illustrates one embodiment of a winch module 178 that includes winch mounts 178*c*. Those of ordinary skill in the art will readily recognize that the winch mounts 178*c* may align with any combination of lubricator mounts 176*a* and/or support tray bores to secure the winch module 178 to the stripper device while in the access position. As such, the winch module 178 operatively assists in servicing the stripper device, for example, among others, moving a lubricator pipe between operative and access positions and retrieving a dipper assembly while downhole. Specifically, in one embodiment, a servicing line 178*d* from the winch module 178 couples to at least one lift eye on the lubricator pipe 177 to move the lubricator pipe 177 either away from or toward the wellhead.

As illustratively shown in FIGS. 1 and 2, the pivot element 33 operatively renders the lubricator pipe 12 of the lubricator assembly 10 to communicate with the wellhead 7 in a first position and renders the lubricator pipe 12 apart from the wellhead 7 in a second position. Specifically, in FIG. 1, the pivot element 33 renders the lubricator assembly 10 in a first position to communicate with the wellhead 7. For purposes of illustration, in one embodiment, the first position comprises an operational position characterizing the configuration of the stripper device 5 as the dipper assembly 70 traverses the wellbore. In particular, while in the operational position, the lubricator assembly 10 includes a lubricator pipe 12 that communicates with the wellhead 7. Accordingly, a dipper assembly traverses within the well, through the wellhead 7 and within the lubricator pipe 12. Hydrocarbon fluids are drawn from the dipper assembly 70 while positioned within the lubricator assembly 10 and pumped to the collector 39 or other hydrocarbon storage container that is well known in the industry.

Furthermore, the pivot element renders the lubricator assembly apart from the wellhead in a second position as shown in FIGS. 11, 12, and 12A-C. For purposes of illustration, in one embodiment, the second position comprises an access position characterizing the configuration of the stripper device 5 rendered for immediate downhole entry to the well without further modification or removal of the stripper device 5 with respect to the wellbore site. As such, the immediate downhole entry that is achieved while the stripper device 154 remains coupled with the wellhead 169 circumvents the costly and potentially damaging effort of constantly removing and resetting the striper device 154 at the wellbore site.

Illustratively, as generally shown in FIG. 12, a lubricator pipe 177 no longer communicates with the wellhead 169 as the recovery assembly 170 is rendered in the access position. In one embodiment, the lubricator pipe 177 is stabilized while in the access position. Moreover, as shown for the recovery assembly 150 of FIG. 11, a pivot element 151 in second position facilitates access to at least one dipper assembly 152 without the lubricator pipe 155 obstructing entry to the wellhead 169. The at least one dipper assembly 152 is drawn from within the well to the wellhead 169 and then removed away from the wellhead 169. Accordingly, in one embodiment, the access position facilitates ease of removal of the at least one dipper assembly 152 as the stripper device 154 remains coupled to the wellhead 169. In one embodiment, the pivot element 151 positions a lubricator assembly 153 apart from the wellhead 169 to expose the wellhead 169 without further obstruction by the lubricator pipe 155.

Referring now to FIG. 11, one embodiment of a stripper device 154 is rendered in an access position by a recovery assembly 150. The recovery assembly 150 includes a pivot element 151. The pivot element 151 is coupled to a lubricator pipe 155 and to a wellhead 107. The pivot element 151 renders the lubricator pipe 155 to communicate with the wellhead 107 in a first position and renders the lubricator pipe 155 apart from the wellhead 107 in a second position.

In one embodiment, the recovery assembly 150 further includes an anchoring flange 157. Shown in FIG. 11, the anchoring flange 157 is secured to and in communication with the wellhead 169. The anchoring flange 157 is coupled to a support tray 232 and extends outwardly from the support tray 232. In one embodiment, the anchoring flange 157 is coupled to the pivot element 151 and extends outwardly from the pivot element 151. In effect, the anchoring flange 157 secures the stripper device 160 to the wellhead 169. Moreover, the anchoring flange 157 facilitates portability for the stripper device to provide for easy removal and connection from one wellhead to another. Specifically, the entire stripper device 170 is easily removed from its location at an aliphatic hydrocarbon well site by simply unsecuring the anchoring flange 157 from the wellhead 169. In one embodiment, once the anchoring flange 157 is removed from the wellhead 169, the stripper device 160 is configured of sufficient size and weight to be entirely loaded and transported within a pickup truck.

Moreover, in one exemplary embodiment, the pivot element 151 is coupled to the anchoring flange 157. In FIG. 11, the pivot element 151 remains secured to the anchoring flange 157 as the pivot element 151 renders the lubricator pipe 155 in a second position to no longer communicate with the wellhead 169.

In one embodiment, the pivot element 151 is releasably coupled to the wellhead 169. In one embodiment, the pivot element 151 is releasable from the anchoring flange 157 to facilitate removal of the lubricator assembly 153 as the stripper device 154 remains secured to the wellhead 169. The pivot element 151 in one embodiment is releasable to remove the lubricator pipe 155 from the stripper device 154.

The recovery assembly 150 further includes lift eyes 156 disposed on the lubricator pipe 155. The lift eyes 156, in cooperative engagement with the pivot element 151, facilitate movement of the lubricator pipe 155 between the first and second positions. In one embodiment, the lift eyes 156 are disposed along the center of gravity of the lubricator pipe 155.

As optionally shown in FIG. 11A, the recovery assembly 150 includes an alignment stopper 252. In one embodiment, the alignment stopper 252 is disposed on the pivot element 151 and extends outwardly from the pivot element 151. In operation, the alignment stopper 252 either rests against the stripper device 154 or wellhead 169 to control the angle of inclination of the lubricator pipe 155 with respect to the stripper device 154 while rendered in the access position. In the embodiment of FIG. 11, the alignment stopper 252 is variably adjustable to provide a desired angle for the lubricator pipe 155 to rest while in the access position.

Optionally, the recovery assembly 150 includes a winch module. As illustrated for the recovery assembly 170 in FIG. 12B, the winch module 178 includes a winch 178*a* of a type well known in the industry and a winch anchor 178*b* to secure the winch 178 to the stripper device. In one embodiment shown in FIG. 12 B, the winch anchor 178*b* interfaces with the pivot element 172 to ultimately attach to the stripper device. In an alternative embodiment shown in FIG. 12B, the winch anchor 178*b* mounts to either the anchoring flange 173 as shown or the wellhead 169. For example, the winch anchor 178 mounts to the wellhead 169 to provide anchoring force for winching a heavy lubricator pipe 177 whereas the winch anchor 178 mounts to the anchoring flange 173 to provide relatively less anchoring force for winching a dipper assembly to move along the wellbore.

As generally shown in FIG. 11, a dipper assembly 152 is removed away from the wellhead 169 and the stripper device 154. The dipper assembly 152 in one embodiment includes a retrieval mounting portion 159 for interchangeably receiving a variety of fishing neck assembly configurations, as discussed in greater detail below with reference to FIGS. 4-9. Those of ordinary skill in the art will readily recognize that the retrieval mounting portion 159 is configured to receive any combination of fishing neck assemblies of a type well known in the industry for easy, downhole retrieval of the dipper assembly 152 such as, among others, a WL pulling tool, an R fishing neck profile, an OTIS fishing neck profile, an SB fishing neck profile, and an external JDC fishing neck profile.

Each fishing neck assembly 158 couples to a distal end of a wireline. Accordingly, the recovery assembly 150 is repositioned within the well while coupled to the wireline and the fishing neck assembly 158 that is secured to the retrieval mounting portion 159 of the dipper assembly 152. As shown in FIG. 1, the wireline 16 is dispensed from a draw assembly 20.

The recovery assembly 150 for the embodiment of FIG. 11 features the retrieval mounting portion 159. Specifically, in one embodiment, the retrieval mounting portion 159 is characteristically modular such that the retrieval mounting portion 159 releasably couples to the dipper body 152*a* of a dipper assembly 152. Accordingly, in operation, the retrieval mounting portion 159 is configured to fixedly receive a fishing tool, a pulling tool or other retrieval tool of a type well known in the industry, including a fishing neck assembly and a shearing pulling tool, to operatively recover the dipper assembly 152 from downhole. Specifically, the retrieval mounting portion 159 includes a receiving pin 152*c* and, optionally, a tapered latch 152 *b* and a mounting portion retrieval neck.

As shown, the retrieval mounting portion 159 defines a receiving pin 152*c* for interchangeably receiving a variety of standard fishing neck assemblies thereon. Optionally, the retrieval mounting portion 159 defines an integrated fishing neck to be used in conjunction with the fishing neck assembly 158 that is coupled to the receiving pin 152*c*, or in lieu of the fishing neck assembly 158, for retrieval of the dipper assembly 152. Specifically, the integrated fishing neck of the retrieval mounting portion 159 includes at least one tapered latch 152*b* and a mounting portion retrieval neck. In one embodiment that is characteristically without an integrated fishing neck, the retrieval mounting portion 159 includes a body with the receiving pin 152*c* extending outwardly from the body.

FIG. 7 further illustrates a mounting portion retrieval neck 84*a*. In operation, the at least one tapered latch 152*b* and mounting portion retrieval neck collectively receive a pulling tool, such as among others an OTIS pulling tool profile, a CAMCO pulling tool profile, an RB pulling tool profile, an RS pulling tool profile, LJ/RJ pulling tool profiles, SBs as well as SMs shearing pulling tool profiles, and other conventional releasable pulling tools, to retrieve the dipper assembly 152 from downhole.

Moreover, the recovery assembly 150 further includes a striker unit 152*d* that is coupled to one end of the dipper assembly 152 opposite of the retrieval mounting portion 159. Specifically, in one embodiment, the striker unit 152*d* is characteristically modular such that the striker unit 152*d* releasably couples to the dipper assembly 70. In operation, the striker unit 152*d* controls the rate of aliphatic hydrocarbons passing through the dipper assembly 152. Those of ordinary skill in the art will readily recognize that the striker unit 152 may be coupled at any location on the dipper body 152*a* that is suitable for facilitating selective actuation of the striker unit 152*d* through either direct physical or remotely networked means.

At least one method may be appreciated for accessing a wellhead. The wellhead, in one exemplary embodiment, defines the terminus of an aliphatic hydrocarbon well, such as, among others, a petroleum well. While in an operational position, a pivot element facilitates communication of a lubricator assembly with a wellhead to permit unobstructed travel of a dipper assembly therein.

Illustratively, in one exemplary embodiment, as shown in FIG. 12, a pivot element 172 includes a first plate 174 coupled to a lubricator pipe 177 and a second plate 175 coupled to a wellhead 169. In the operational position, the first plate 174 and the second plate 175 are secured together with fasteners to maintain the established communication between a lubricator assembly and the wellhead 169 for travel of the dipper assembly therethrough.

While in the access position, the second plate 174 of the pivot element 172, in one embodiment, remains secured to the support tray 187 and thus coupled to the wellhead 169. Alternatively, the second plate 174 is removed from the support tray 187 while in the access position to remove the lubricator assembly entirely from the stripper device.

In the continuing method for accessing a wellhead, fasteners are removed from the pivot element 172. The pivot element 172 then moves the lubricator pipe 177 apart from the wellhead 169 thereby terminating the established communication with the wellhead 169 and rendering the pivot element 172 in an access position.

Moreover, at least one method may be appreciated for retrieving a dipper assembly from within a wellbore. In a first position, fasteners are removed from a pivot element. The pivot element is coupled to a lubricator assembly and a wellhead.

A servicing line is secured to at least one lift eye on a lubricator pipe to move the lubricator pipe away from the wellhead. A winch module in one embodiment supplies the servicing line to move the lubricator assembly. In at least one embodiment, the lubricator pipe is stabilized while in an access position. Optionally, as shown in FIG. 11, an alignment stopper may be coupled to the pivot element to adjustably stabilize the position the lubricator pipe while in the access position.

In the access position, the lubricator assembly is moved away from the wellhead such that the lubricator assembly no longer communicates with the wellhead. The dipper assembly is drawn from within the well toward the wellhead by securing either a fishing or pulling tool to a retrieval mounting portion defined by the dipper assembly. Specifically, in one embodiment, a fishing tool is secured to the fishing neck assembly of a dipper assembly. Accordingly, the dipper assembly is removed from the wellhead.

Once removed from the well, the dipper assembly may be serviced. In one embodiment, servicing a dipper assembly includes removing one fishing neck assembly from the dipper assembly for replacement with another fishing neck assembly on to the dipper body. Illustratively, in one embodiment, the replacement of fishing necks can take place as a stripper device is relocated to another well site having a different wellbore size or depth and thus requiring a different sized dipper assembly and correspondingly sized fishing neck assembly. Similarly, a retrieval mounting portion from the dipper assembly may be modularly exchanged for another retrieval mounting portion having a different configuration and thus coupled to the dipper body to accommodate configuration changes between different well sites. Moreover, during servicing, a striker unit from the dipper assembly can be removed and replaced with another striker unit.

Now, with specific reference to the dipper assembly of FIGS. 4-9, each dipper assembly 70 is generally characterized as a selectively sealable fluid container for collecting liquid aliphatic hydrocarbons from a well. The dipper assembly 70 includes a dipper body 71. In one embodiment, the dipper body 71 is an elongated, thin-walled metallic container configured for collecting between 1500 cubic inches ($in^3$) and 6500 cubic inches ($in^3$) of fluid at a time as sealed therein. Those of ordinary skill in the art will readily recognize that the interior volumetric size of the dipper body 71 is a function of length of the dipper assembly 70 and inner-diameter pipe size of the wellbore. In another embodiment, the dipper body 71 is composed of a polymeric material. Those of ordinary skill in the art will readily recognize other configurations or material compositions for the dipper body 71.

Figure 6:
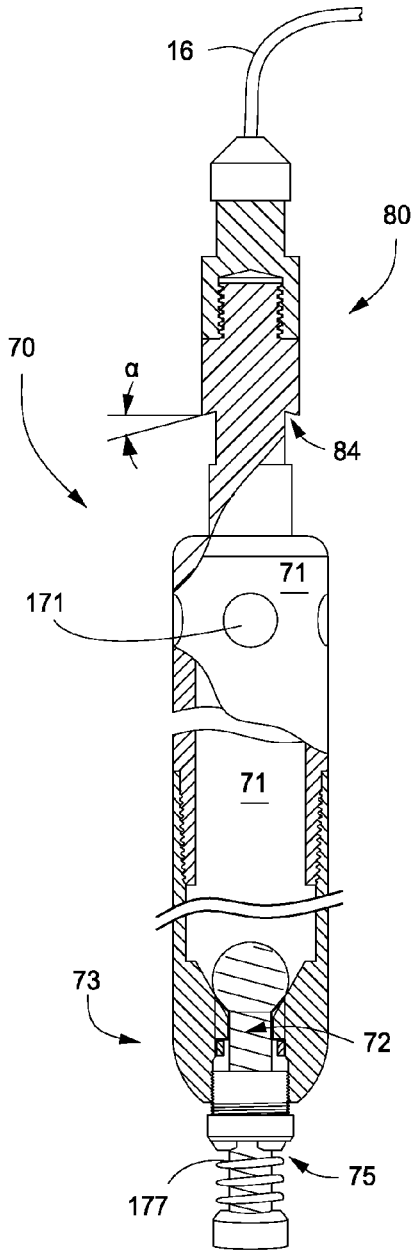
FIG. 6 and FIG. 7 are generally exploded, partially cut-away views from the side of at least one exemplary embodiment of a dipper assembly for containing aliphatic hydrocarbon fluids such as, among others, petroleum, the dipper assembly including a retrieval mounting portion for facilitating ease of removal of the dipper assembly from the wellhead, the retrieval mounting portion including at least one receiving pin, specifically

In general, FIGS. 6-7 refer to at least one exemplary embodiment of a dipper assembly 70 for containing aliphatic hydrocarbons such as, among others, petroleum. Each dipper assembly 70 includes a retrieval mounting portion 80 for facilitating ease of removal of the dipper assembly 70 from downhole with service equipment of a type well known in the industry such as, among others, an OTIS fishing neck profile, an internal GS fishing neck profile, an SD fishing neck profile, and ODC fishing neck profile, an external JDC fishing neck profile, an OTIS pulling tool profile, a CAMCO pulling tool profile, an RB pulling tool profile, an RS pulling tool profile, LJ/RJ pulling tool profiles, SBs as well as SMs shearing pulling tool profiles, and other releasable pulling tools.

As shown in FIGS. 6-7, the dipper body 71 defines a plurality of dipper ports 171. Generally, the plurality of dipper ports 171 are poisoned on the dipper body 71 above a striker unit 73. Illustratively, in one embodiment, the dipper ports 171 are disposed near one end of the dipper body 71 that is closest to fluid boundary while downhole. Accordingly, as the dipper body 71 hits fluid, petroleum is more likely to enter through the dipper ports 171 positioned closest to the fluid boundary on the dipper body 71 as the density of liquid petroleum is lighter than water whereby both fluids collectively define, at least in part, the liquid column of the aliphatic hydrocarbon well. In one embodiment, the dipper body 71 defines a multiplicity of dipper ports 171. In at least one embodiment, the dipper ports 171 form any combination of alphanumeric characters as well as geometrical figures.

The dipper assembly 70 includes a removable striker unit 73. The striker unit 73 is coupled to one end of the dipper body 71. In one embodiment, the striker unit 73 is positioned at the end of the dipper body 71 that will initially hit fluid. As shown in the embodiment of FIG. 7, the striker unit 73 is threadedly coupled to the dipper body 71. In operation, the striker unit 73 is shown in FIG. 7A as rendered in a draw position for channeling at least one fluid through the dipper assembly 70 and is shown in FIG. 7B as rendered in a fill position for sealing at least one fluid within the dipper assembly 70.

Generally, in one embodiment, the striker unit 73 is shown in FIG. 7A as having a collection valve 72 that is unseated to render the dipper assembly 70 in a draw position. In the draw position, aliphatic hydrocarbons such as, among others, liquid petroleum are channeled through the dipper assembly 70.

In one operation, the striker unit 73 in the draw position absorbs the forces of impact with the liquid as the dipper assembly 70 hits fluid to permit the liquid petroleum and other hydrocarbons to initially enter within the dipper assembly 70 through the striker unit 73. While submerged in the liquid column, the collection valve 72 seats to maintain a seal for holding liquids within the dipper assembly 70 until the striker unit 73 is rendered in the draw position. In another operation, the striker unit 73 is rendered in the draw position as it is contacted by a flapper115 of a dump arrangement 110 provided in a dump position. The flapper 115 contacts a striker unit 73 to ultimately unseat a collection valve to empty the hydrocarbons from with the dipper assembly 70 for collection thereof.

The striker unit 73 is shown in FIG. 7B as rendered in a fill position for sealing at least one hydrocarbon fluid within the dipper assembly 70. In particular, striker unit 73 includes a collection valve 72 that is seated to define a seal as the dipper assembly 70 is rendered in the fill position.

As shown in FIGS. 6-9, the collection valve 72 includes striker stem 77. In operation, the striker stem 77 is rendered between a fill position and a draw position to selectively seal the aliphatic hydrocarbons within the dipper body 71. Illustratively, in FIG. 9A the striker stem 77 positions a valve piece 77*a* "off-seat". An "off-seat" configuration refers to the valve piece 77 that is positioned apart from a corresponding mechanical seal 77*c* to thus characterize the dipper assembly 70 in the draw position.

In FIG. 9B, the striker stem 77 positions the valve piece 77*a* "on seat" that is defined as being mated with the valve piece's 77*a* corresponding mechanical seal 77*c* to thus characterize the dipper assembly 70 in the fill position. In at least one embodiment, as shown, the valve piece 77*a* as well as an opposing stop piece 77*b* are releasably coupled to the striker stem 77 to facilitate easy access for servicing and manufacturing.

As shown, in FIGS. 6-7 the valve piece 77*a* comprises a ball valve whereas the valve piece 77*a* for embodiment of FIG. 9 comprises a flat head valve. Those of ordinary skill in the art will ready recognize that the valve piece 77*a* may comprise any valve head that will reliably seat and provide a seal over a period of heavy usage. Illustratively, the flat head valve piece shown in FIG. 9 seats on the corresponding mechanical seal to reliably seat and provide a seal over a period of heavy usage.

The striker unit 73 further includes an impact compensator 177. In one embodiment, the impact compensator 177 is disposed on the striker stem 77 between an exterior surface at one distal end of the dipper body 71 and the stop piece 77*b*.

The impact compensator 177 supplies a resilient force to the striker stem 77 to counteract movement of the stop piece 77*b* as the dipper assembly 70 initially contacts the fluid boundary or "hits fluid". Initially, while impacting the fluid boundary, the stop piece 77*b* moves toward the dipper body 71 to compress the impact compensator 177. At the moment of fluid boundary impact, the impact compensator 177 acts as a spacer for preventing the stop piece 77*b* from obstructing fluid flow into dipper assembly 70 thereby permitting liquid fluid to enter through the collection valve 72 opening formed by the "off-seat" valve piece 72*a* and along the striker stem 77 as the dipper body 71 is initially filled with the liquid. Thereafter, while the dipper assembly 70 is submerged in liquid fluid, the resilient forces from the impact compensator 177 gradually move the stop piece 77*b* away from the dipper body 71 to urge the valve piece 77*a* to seat on the mechanical seal 77*c*. The impact compensator 177 extends to its normally expanded configuration thereby sealing the collection valve 72 while submerged in the liquid column until the dipper assembly 70 is retrieved from the wellhead by the stripper device and then opened via a dump manifold.

FIG. 7A illustrates one embodiment of a striker unit including an impact compensator 177 for governing the rate of fluid passing through the dipper assembly 70. In at least one embodiment, the impact compensator 177 comprises a resilient member with a predefined rate of restorative displacement. In at least one embodiment, the impact compensator 177 comprises a spring with a predetermined spring constant. In one embodiment, the impact compensator 177 comprises a dashpot with a predefined rate of restorative potential energy.

Illustratively, in operation, the impact compensator 177 resiliently compresses when hitting fluid to absorb the forces of impact with the liquid while permitting the liquid petroleum to initially enter within the dipper assembly, see FIG. 9A. The resilient force provided by the impact compensator 177 facilitates a gradual transition period between a draw and a fill position to optimize collection of liquid at the fluid boundary as the dipper assembly 70 becomes entirely submerged therein. Namely, fluid enters initially through the striker unit 73 and also then through dipper ports 171 at the opposing end of the dipper body 71 as the impact compensator 177 gradually returns to its normally extended position to effectively seal the aliphatic hydrocarbons nearest to the fluid boundary within the dipper assembly 70 while submerged within the liquid hydrocarbons.

As the dipper assembly 70 returns to the gaseous air mixture above the fluid boundary from being submerged in liquid column in the well, the resilient forces from the impact compensator 177 counteract forces exerted on the striker stem 77 from the liquid contained within the dipper assembly 70 to maintain the seal within the dipper body 71 as the collection valve 72 is rendered in a fill position. The weight of the hydrocarbons contained within the dipper assembly 70 further assist to push out against the interior of the dipper body 71 to ensure the striker units' 73 valve piece 77*a* is seated to seal the dipper assembly 70.

In another operation, the impact compensator 177 resiliently compresses while contacted by a flapper 115 of a dump arrangement 110 that is rendered in a dump position. The flapper 115 contacts a striker unit 73 to ultimately unseat the valve piece 77*a* to empty the hydrocarbons from with the dipper assembly 70 for collection thereof. When the dipper assembly 70 is emptied, the flapper 15 moves away from the striker unit 73 such that the impact compensator 177 resiliently returns to its normally extended position to seal the dipper assembly 70.

Generally, in a further embodiment, a stripper device is provided for an aliphatic hydrocarbon well, the aliphatic hydrocarbon well includes a fluid boundary having petroleum floating on a liquid column of aliphatic hydrocarbons and other liquids that are located adjacent to the fluid boundary. The stripper device includes a dipper assembly having a dipper body with a distal end and a striker unit coupled to the distal end. The striker unit includes a collection valve having a valve piece that is seated to define a mechanical seal for containing liquid hydrocarbons as the dipper assembly is rendered in the fill position. The collection valve includes a striker stem that is coupled to a stop piece and to the valve piece located within the interior of the dipper body. The stop piece provided by the collection valve is positioned on the striker stem on the outside of the dipper assembly and adjacent to the exterior surface of the dipper body. The striker unit further includes an impact compensator disposed on the striker stem between an exterior surface at the distal end of the dipper body and the stop piece.

As the dipper body is submerged in liquid fluid, the resilient forces from the impact compensator gradually move the stop piece on the striker stem away from the dipper body to urge the valve piece disposed on the striker stem within the dipper body to seat on the mechanical seal to thereby render the dipper assembly in a fill position while submerged within the liquid hydrocarbons. As the dipper assembly returns to a gaseous air mixture above the fluid boundary from being submerged within the liquid column of the well, the resilient forces from the impact compensator counteract forces exerted on the striker stem to maintain the seal within the dipper body as the collection valve is rendered in the fill position. Illustratively, the impact compensator counteracts shear forces exerted on the striker stem from the liquid contained within the dipper assembly.

Initially, the impact compensator prevents the stop piece from obstructing fluid flow into the dipper assembly by resiliently absorbing shock forces exerted at the fluid boundary following impact by the dipper assembly at the fluid boundary. The impact compensator at least in part facilitates entry of liquid fluids through the collection valve opening formed by the temporarily separated striker stem and valve piece so that the dipper body is initially filled with liquid petroleum and other aliphatic hydrocarbons. In one embodiment, liquid petroleum and other aliphatic hydrocarbons at the fluid boundary initially enter through the striker unit and also then through the plurality of dipper ports provided at the opposing end of the dipper body as the impact compensator gradually returns to its normally extended position to effectively seal the aliphatic hydrocarbons within the dipper assembly while submerged within the liquid column that includes liquid hydrocarbons.

As shown in FIG. 8, the striker unit 73 further includes a limit collar 75. In operation, the stop piece 77*b* and impact compensator 177 are urged against the limit collar 75 as the dipper assembly 70 is rendered in a draw position. In one embodiment, the limit collar 75 forms a plurality of tabs 78 for contacting the stop piece 77*b* and impact compensator 177. In the embodiment of FIG. 8, the limit collar 75 defines a plurality of recessed passageways 78*a* between the tabs 78. Each region between the adjacent tabs defines a recessed passageway 78*a* 78. The plurality of recessed passageways 78*a* 78 facilitate the flow of liquid hydrocarbons through the dipper assembly 70 as the striker unit 73 is rendered in the draw position. In one embodiment, the plurality of tabs 78 comprise fluted tabs.

Operatively, the recessed passageways 77*a* permit the flow of hydrocarbons through the dipper assembly 70 as the stop piece 77*b* is compressed against the limit collar 75 while the striker stem 77 operates to unseat the valve piece 77*a* within the interior of the dipper body 71. In particular, the plurality of tabs 78 provide space for fluid to flow through the dipper assembly 70, along the striker stem 77.

Referring now to FIGS. 6-7, the dipper assembly 70 further includes a retrieval mounting portion 80. The retrieval mounting portion 80 is disposed on the dipper body 71 to provide a reliable coupling interface to the dipper assembly 70 for recovery while downhole. Generally, the retrieval mounting portion 80 includes a receiving pin 83 and, optionally, a tapered latch 84 with a mounting portion retrieval neck 84*a*. During operation of the stripper device, the retrieval mounting portion 80 facilitates coupling of the dipper body 71 with the wireline 16. Moreover, during servicing, the retrieval mounting portion 80 is configured to receive either a fishing tool, pulling tool or other retrieving tool to recover the dipper assembly 70 from downhole, such as, among others, situations where the wireline is no longer operational to move the dipper assembly along the wellbore.

The retrieval mounting portion 80 is disposed on an end of the dipper body 71 that opposes the striker unit 73. In one embodiment, a plurality of retrieval mounting portions are disposed about the dipper body 71.

The retrieval mounting portion 80 includes a receiving pin 83. The receiving pin 83 operatively couples to at least one fishing neck assembly 85 provided by the dipper assembly. The receiving pin 83 in one embodiment releasably receives a variety of standard fishing neck assemblies. In one embodiment, the retrieval mounting portion 80 includes a plurality of receiving pins each disposed on the dipper body 71. Each receiving pin operatively couples to corresponding fishing tool, a pulling tool or other retrieval tool of a type well known in the industry to recover the dipper assembly 70 from downhole.

Specifically, the fishing neck assembly 85 comprises a fishing neck assembly that is well known in the industry and integrates with the dipper body 71 at the receiving pin 83. During operation of the stripper device, the fishing neck assembly 85 and receiving pin 83 generally facilitate coupling of the dipper body 71 to the wireline 16. Moreover, during servicing, the fishing neck assembly 85 is configured to receive either a fishing or pulling tool thereon to retrieve the dipper assembly 70 from downhole. In at least one embodiment, the fishing neck assembly 85 is configured to mate with a fishing tool, a pulling tool or other retrieval tool of a type well known in the industry, for example, among others, an OTIS fishing neck profile, an internal GS fishing neck profile, an SD fishing neck profile, and ODC fishing neck profile, an external JDC fishing neck profile, an OTIS pulling tool profile, a CAMCO pulling tool profile, an RB pulling tool profile, an RS pulling tool profile, LJ/RJ pulling tool profiles, and SBs as well as SMs shearing pulling tool profiles.

Specifically, the fishing neck assembly 85 includes a fishing neck 87, a rope socket 86 coupled to the fishing neck 87, as well as an anchoring collar 82 coupled to the fishing neck 87 and opposingly positioned relative to the rope socket 86. In FIG. 7, the anchoring collar 82 releasably couples with the receiving pin 83 to accommodate a variety of a fishing neck assemblies or other well known retrieval tools in the industry.

With the retrieval mounting portion 80, the dipper assembly 70 may be recovered from the well with a variety of well known oilfield tools in such illustrative events where the wireline 16 becomes detached from the rope socket 86 or the dipper assembly 70 becomes lodged while in the wellbore. Once the dipper assembly is retrieved for servicing, either a fishing neck assembly 85 is exchanged for another or the fishing neck assembly 85 is removed, repaired, and then recoupled to the receiving pin 83 on the dipper body 71. In another illustration, one fishing neck assembly 85 is substituted for another fishing neck assembly or other well known retrieval tool of a different size or performance capacity.

Optionally, as shown, the retrieval mounting portion 80 includes at least one tapered latch 84 and a mounting portion retrieval neck 84*a*, each adjacent to the receiving pin 83 in this particular embodiment. The at least one tapered latch 84 and the mounting portion retrieval neck 84*a* collectively provide an integrated fishing neck on the retrieval mounting portion 80 for receiving a fishing tool or other pulling tool thereon.

Accordingly, the retrieval mounting portion 80 defines an integrated fishing neck to be used in conjunction with the fishing neck assembly 85 coupled to the receiving pin 83 or in lieu of the fishing neck assembly 85 for downhole retrieval of the dipper assembly 70.

In operation, the at least one tapered latch 84 and a mounting portion retrieval neck 84*a* are each configured to securedly receive a retrieval tool to ultimately recover the dipper assembly 70 from the wellbore. For example, if the dipper assembly 70 cannot be retrieved with a wireline, the at least one tapered latch 68 receives a retrieval tool of a type well known in the industry such as, among others, an OTIS pulling tool profile, a CAMCO pulling tool profile, an RB pulling tool profile, an RS pulling tool profile, LJ/RJ pulling tool profiles, and SBs as well as SMs shearing pulling tool profiles.

As shown in FIGS. 6 and 7B, the tapered latch 84 is configured to extend from the mounting portion retrieval neck 84*a* at an angle, a, from a horizontal plane. In one embodiment, the angle a is defined at 10° to facilitate optimal interface with a retrieval tool thereon, such as a fishing tool or a pulling tool of a type well known in the industry.

Referring to FIGS. 7, 7A, 7B, the retrieval mounting portion 80 optionally includes a wireline tool modular interface 81 that is releasably coupled to the dipper assembly 70. Specifically, the wireline tool modular interface 81 facilitates releasable coupling of the retrieval mounting portion 80 from the remaining dipper body 71. For ease of manufacturing, the retrieval mounting portion 80 is assembled as a modular unit for coupling to the dipper body 71 with the wireline tool modular interface 81. Illustratively, as shown in FIG. 7, the wireline tool modular interface 81 threadedly couples to the dipper body 71. Similarly, in FIG. 7A, the wireline tool modular interface 81 threadedly couples to one end of the dipper body 71. FIG. 7B illustratively shows a wireline tool modular interface 81 as a weld for coupling to the dipper body 71.

Shown in FIGS. 6-7, a wireline 16 is secured to the dipper assembly 10 with the rope socket 86. Moreover, the wireline 16 is also secured to a draw assembly 20 to position the dipper assembly 70 along the wellbore. While the wireline 16 remains coupled to a draw assembly 20 of the stripper device 5, the dipper assembly 70 is suspended at the rope socket 86 with a variable length of the wireline 16 to position the dipper assembly 70 along the wellbore at a correspondingly predetermined distance.

With reference to FIGS. 13 and 14, an electrical power recovery system 200 is generally provided. The electrical power recovery system 200 regulates the supply of electrical power to a stripper device for the collection of aliphatic hydrocarbons from a hydrocarbon well with a dipper assembly. In one embodiment, to facilitate portability and operational autonomy of a stripper device, the electrical power recovery system 200 manages various networked power sources to cooperatively provide operational power to the stripper device. Those of ordinary skill in the art will recognize that the electrical power recovery system 200 is one illustration for regulating power for the collection of aliphatic hydrocarbons with a dipper assembly.

As schematically shown in FIG. 13, the electrical power recovery system 200 includes an energy manager system 205. The electrical power recovery system 200 is coupled to a stripper device and to at least one electric power source, such as, among others, an external electrical supply line. The operations of the electrical power recovery system 200 is executed by a controller assembly of the stripper device. Specifically, in one embodiment, the operations of the electrical power recovery system 200 are executed by the control module 205 for the stripper device.

In particular, the controller assembly includes an energy manager system 207. The energy manager system 207 includes a processor 207*a*. The processor 207*a* is coupled to the control module 205 and to a battery 217.

As schematically shown in FIG. 13, the energy manager system 207 includes a plurality of line sensors 202. The plurality of line sensors 202 are coupled to the processor 207*a*. Each line sensor 202 provides a status signal to the processor 207*a*. In one embodiment, at least one status signal includes information associated with the amount of electric power stored in the battery 217. Another status signal includes information associated with the amount of electric power available by an electric power source 208. In one embodiment, the electric power source 208 comprises an external electrical power source such as, among others, an AC power grid.

The processor 207*a* receives the status signals and determines the amount of electric power available from the electric power source 208 and stored in the battery 217 to collectively operate the stripper device via the energy manager system 207. As shown in FIG. 13, at least one supervisory control data and acquisition (SCADA) system 209 is coupled to the electrical power recovery system 200 for remote management thereof. The SCADA system 209 remotely determines the amount of electric power available from the electric power source 208 and stored in the battery 217, among other components, to operate the stripper device via the electrical power recovery system 200.

The electrical power recovery system 200 further includes a wireline reverse motor recharge system 211. In one embodiment, the motor 44 of the controller assembly 40 features the wireline reverse motor recharge system 211 for generating electric power for each time the dipper assembly is carried downhole, in part, with the earth's gravitational forces. The wireline reverse motor recharge system 211 is coupled to the processor 207*a* and at least one sensor from the plurality of line sensors 202. At least one sensor from the plurality of line sensors 202 provides a status signal including information associated with the amount of electric power provided by the wireline reverse motor recharge system 211.

In operation, for each time force of gravity is applied to the dipper assembly while traveling down the wellbore, the wireline reverse motor recharge system 211 coupled to the dipper assembly correspondingly generates electric current for the electrical power recovery system 200. Specifically, gravitational forces act on the falling dipper assembly such that the wireline turns an electric armature of the wireline reverse motor recharge system 211 to generate electric current. In one embodiment, the electric power generated by the electrical power recovery system 200 is stored in the battery 217. Shown in FIG. 13, an invertor 219 is provided between the electrical power recovery system 200 and the battery 217 ensure a continuous supply of AC current to the controller assembly and other components of the stripper device. Moreover, as shown in FIG. 14, an electric power recovery system 184 is coupled to the controller assembly 185 and a battery module 186.

Optionally, in one embodiment, the electrical power recovery system 200 further includes a backup generator 213. The backup generator 213 is coupled to the processor 207*a* and at least one line sensor from the plurality of line sensors 202. The at least one line sensor 202 provides a status signal including information associated with the amount of electric power provided by the backup generator 213. In operation, the controller module 205 and processor 207*a* cooperatively activate the backup generator 213 based on status signals indicating a deficiency of power throughout the electrical power recovery system 200 that is necessary for operating the stripper device.

A method for managing electric power for a stripper device is appreciated as follows. An energy manager system is coupled to a processor, a control module from a stripper controller assembly, and to an electric power source.

A plurality of line sensors are coupled to the processor. Each sensor provides a status signal to the processor.

Moreover, a battery is coupled to the processor and at least one line sensor from the plurality of line sensors. In operation, at least one status signal is provided to the processor from the at least one line sensor coupled to the battery. The at least one status signal includes information associated with the amount of electric power stored in the battery.

In one embodiment, a line sensor is coupled to the electric power source. At least one status signal is provided to the processor from the line sensor coupled to the electric power source. The at least one status signal includes information associated with the amount of electric power available by the electric power source.

Accordingly, the processor receives the plurality of status signals and determines the combined amount of electric power from the battery and the electric power source that is required to continuously operate the stripper device. Accordingly, based on the processor's determination of the amount of electric power needed, the energy manager system and the control module collectively provide computer readable instructions for continuously supplying the required electric power for operating the striper device.

In one embodiment, a line sensor is coupled between a processor and a photovoltaic collector module. In another embodiment, a line sensor is coupled between a processor and a backup generator. In one embodiment, a line sensor is coupled between a processor and a reverse motor recharge system.

For the embodiments shown in FIGS. 13 and 14, the electrical power recovery system 200 includes a photovoltaic collector module 215. The photovoltaic collector module 215 is coupled to the battery 217 and the energy manager 207.

As shown in FIG. 14, a stripper device 180 includes a photovoltaic collector module 181. The photovoltaic collector module 181 is coupled to an electric power recovery system 184, a controller assembly, and a battery module 186 to generate electrical power to operate the stripper device 180 and for storage in the battery module 186.

The photovoltaic collector module 181 includes a plurality of photovoltaic elements 183 anchored to a collector support 183. Each photovoltaic element 183 generates electric current with solar radiation. In one embodiment, as shown in FIG. 14, the collector support 182 positions the plurality of photovoltaic elements 183 to shelter, at least in part, the stripper device 180. Optionally, a grounded lightning rod 188 may be coupled to the stripper device 180 to, at least in part, protect the stripper device 180 from electrical lightening surges.

Figure 15:
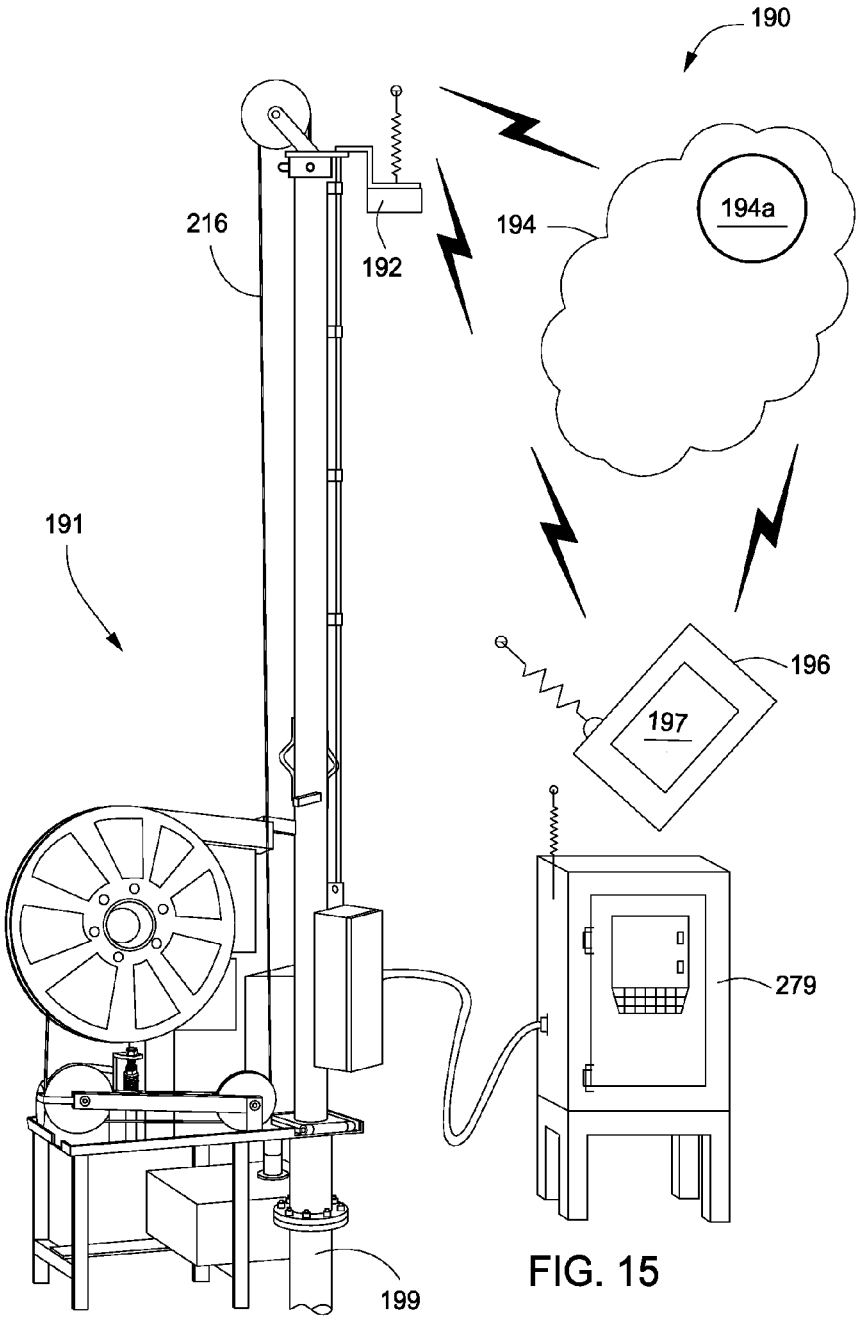
FIG. 15 is an isometric view illustrating one embodiment of a control system for remotely operating at least one stripper device.

With reference to FIG. 15, a control system 190 for a remotely operating at least one stripper device 191 is described as follows. The control system 190 includes a network 194. The network 194 is coupled to the stripper device 191 and to a plurality of stripper devices 194*a* at differing geographic locations and provides instructions in a computer readable format thereto. In one embodiment, the network 194 comprises a wide area network (WAN) whereas, in another embodiment, comprises a local area network (LAN).

The control system 190 includes a supervisory control and data acquisition (SCADA) controller 192 coupled to the network 194 and to a controller assembly 279 of the stripper device 191. In one embodiment, the SCADA controller 192 comprises a remote terminal unit whereas, in an alternative embodiment, the SCADA controller 192 comprises a programmable logic controller.

The controller assembly 279 is coupled to a wireline 216 and a dipper assembly of the stripper device 191. The controller assembly 279 regulates the collection of aliphatic hydrocarbons with the stripper device 191 from a well 199. The controller assembly 279 receives instructions in computer readable format through the SCADA controller 192 for regulating the collection of liquid aliphatic hydrocarbons with a dipper assembly provided by the stripper device 191. The dipper assembly is the same as the dipper assemblies described above.

The SCADA controller 192 is optionally coupled to an energy manager system of an electric power recovery system. Accordingly, the SCADA controller 192 facilitates remote management of electric power for operating the stripper device 191 and also the plurality of stripper devices 194*a* within the network 194.

The control system 190 further includes a portable electronic device 196. As shown in FIG. 15, the portable electronic device 196 is coupled to the network and to the SCADA controller 192. The portable electronic device 196 includes a control interface 197. The control interface 197 facilitates manual input for operating the stripper unit 191. Illustratively, the portable electronic device 196 receives input to regulate the rate of production with the stripper device 191. In one embodiment, the control interface 197 facilitates manual input for operating a plurality of stripper devices via the network 194.

Generally, in a further embodiment, a control system for a stripper device at a well site includes a network. The network defines a plurality of stripper devices including the stripper device at the well site. The network is coupled to the stripper device at the well site and to the plurality of stripper devices in addition to the well site stripper device. The network provides instructions and information in a computer readable format to each stripper device.

The control system includes a SCADA controller coupled to the network and to a controller assembly of the stripper device at the well site. The controller assembly is coupled to a dipper assembly via a wireline, the dipper assembly is provided by the stripper device at the well site. The controller assembly regulates the rate of production of liquid aliphatic hydrocarbons with the stripper device from the well site. In one embodiment, the controller assembly receives instructions in a computer readable format from the SCADA controller to collect liquid hydrocarbons with the dipper assembly.

The control system includes a portable electronic device coupled to the network and the SCADA controller. The portable electronic device includes a control interface. The control interface facilitates a manual input for operating, via the network, a combination of the stripper device at the well site and the plurality of stripper units.

Although the present invention has been described in detail, it should be understood that various changes, substitutions, and alterations could be made hereto without departing from the spirit and scope of the invention as defined by the appended claims.

I claim:

1. A stripper device for a wellhead, the wellhead defining a terminus of an aliphatic hydrocarbon well, the aliphatic hydrocarbon well operating as a stripper well, the stripper device for extracting aliphatic hydrocarbons from the aliphatic hydrocarbon well, the stripper device comprising:

a lubricator assembly, the lubricator assembly including a lubricator pipe in communication with the wellbore, a wireline, and at least one dipper assembly for collecting liquid aliphatic hydrocarbons in a dipper body and coupled to the wireline, the at least one dipper assembly for traversing within the lubricator pipe and the well when the lubricator pipe is in a first position for operation with the wellhead; and a retrieval mounting portion, the retrieval mounting portion including a neck and a tapered rim, the retrieval mounting portion at a first end coupled to and extending away from one end of the dipper body, the retrieval mounting portion further configured at a second end to fixedly receive a retrieval tool, wherein the retrieval mounting portion couples with a driver collar in the lubricator to actuate a pivotable flap below the dipper body via linear movement of the driver collar and the retrieval mounting portion.

2. The stripper device according to claim 1 wherein the retrieval mounting portion includes a receiving pin for receiving a removable fishing neck assembly thereon, the fishing neck assembly configured to mate with the retrieval tool.

3. The stripper device according to claim 1 wherein the retrieval mounting portion defines an integrated fishing neck for receiving the retrieval tool thereon.

4. The stripper device according to claim 1 wherein the retrieval mounting portion includes a wireline tool modular interface, and wherein the wireline tool modular interface releasably couples the retrieval mounting portion to the dipper body of the at least one dipper assembly.

5. The stripper device according to claim 1 wherein the wireline tool modular interface threadedly couples to one end of the dipper body.

6. The stripper device according to claim 1 wherein the retrieval mounting portion includes a wireline tool modular interface, and wherein the wireline tool modular interface couples the retrieval mounting portion to the dipper body of the at least one dipper assembly, the retrieval mounting portion and the dipper body are one integral piece.

7. The stripper device according to claim 1 wherein the retrieval mounting portion includes at least one tapered latch.

8. The stripper device according to claim 7 wherein the retrieval mounting portion includes a mounting portion retrieval neck, and wherein the at least one tapered latch and the mounting portion retrieval neck collectively receive the retrieval tool.

9. A dipper assembly and a stripper device, the stripper device coupled to a wellhead of a production well, the dipper assembly collecting aliphatic hydrocarbons from the production well, the dipper assembly comprising:

a dipper body; and a removable striker unit threadably coupled to a bottom surface of the dipper body, the striker unit including a collar enclosing an opening formed on the bottom surface of the dipper body and a collection valve, the collection valve including a striker stem, near one end of the striker stem is disposed a compensator disposed to urge against the collar, the striker stem is rendered between a fill position and a draw position to selectively seal liquid aliphatic hydrocarbons in the dipper body, wherein the retrieval mounting portion couples with a driver collar in the stripper device to actuate a pivotable flap below the dipper body via linear movement of the driver collar and the retrieval mounting portion.

10. The dipper assembly according to claim 9 further comprising dipper ports defined by the dipper body, the dipper ports forming any of alphanumeric and geometric configurations on the dipper body.

11. The dipper assembly according to claim 9 further comprising a retrieval mounting portion disposed on another end of the dipper body relative to the striker unit.

12. The dipper assembly according to claim 11 wherein the retrieval mounting portion includes a receiving pin for receiving a removable fishing neck assembly thereon, the fishing neck assembly for receiving a retrieval tool.

13. The dipper assembly according to claim 11 wherein the retrieval mounting portion includes a wireline tool modular interface, and wherein the wireline tool modular interface releasably couples the retrieval mounting portion to the dipper body of the dipper assembly.

14. The dipper assembly according to claim 9, wherein the collar defines a plurality of recessed passageways that facilitate flow of the liquid aliphatic hydrocarbons when the striker stem is rendered in the draw position.

15. A dipper assembly and a stripper device, the stripper device coupled to a wellhead of a production well, the dipper assembly collecting aliphatic hydrocarbons from the production well, the dipper assembly comprising:

a dipper body;

a retrieval mounting portion disposed on and extending away from one end of the dipper body, the retrieval mounting portion including a neck, a tapered rim and a receiving pin, the receiving pin at one end of the retrieval mounting portion and configured to interface with a fishing neck assembly, the fishing neck assembly coupled to a wireline and the wireline coupled to a control module, the fishing neck assembly further configured to couple with a driver collar in the stripper device, and when the fishing neck couples with the driver collar, the driver collar actuates a pivotable flap through a rod via linear movement of the dipper assembly, the control module including at least one processor, and the at least one processor implementing a program rendered in a computer readable format for positioning the dipper assembly within the production well and for correcting position of the dipper assembly with respect to the aliphatic hydrocarbons in the production well with the wireline coupled to the dipper body at the fishing neck assembly and for;

a removable striker unit disposed on a bottom surface of the dipper body, the striker unit including a collar enclosing an opening formed on the bottom surface of the dipper body and a collection valve extending from the collar, the collection valve including a striker stem, near one end of the striker stem is disposed a compensator disposed to urge against the collar; and the removable striker unit further configured to engage the pivotable flap when the pivotable flap is actuated by the driver collar when the fishing neck assembly moves the driver collar linearly.

16. The dipper assembly according to claim 15 further comprising a sensor for identifying a fluid boundary.

17. The dipper assembly according to claim 15 wherein the retrieval mounting portion includes a plurality of receiving pins, each receiving pin for receiving its own fishing neck assembly.

18. The dipper assembly according to claim 15 wherein the dipper assembly is in operable communication with a fluid indicator unit for sensing displacement as the dipper body crosses a fluid boundary between air and liquid aliphatic hydrocarbons and between the liquid aliphatic hydrocarbons and a liquid of a heavier density than the liquid aliphatic hydrocarbons.

19. The dipper assembly according to claim 15 wherein the retrieval mounting portion includes a wireline tool modular interface and wherein the wireline tool modular interface releasably couples the retrieval mounting portion to a dipper body of the dipper assembly.

20. The dipper assembly according to claim 15 wherein the retrieval mounting portion includes a wireline tool modular interface, and wherein the wireline tool modular interface couples the retrieval mounting portion to the dipper body of the dipper assembly, the retrieval mounting portion and the dipper body are one integral piece.

* * * * *